US011245167B2

(12) United States Patent
Skiebe

(10) Patent No.: US 11,245,167 B2
(45) Date of Patent: Feb. 8, 2022

(54) COAXIAL FILTER

(71) Applicant: Telefonaktiebolaget LM Ericsson (publ), Stockholm (SE)

(72) Inventor: Martin Skiebe, Stephanskirchen (DE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 16/111,591

(22) Filed: Aug. 24, 2018

(65) Prior Publication Data

US 2019/0067771 A1 Feb. 28, 2019

(30) Foreign Application Priority Data

Aug. 30, 2017 (DE) ..... 10 2017 119 907.1

(51) Int. Cl.

| | |
|---|---|
| ***H01P 1/205*** | (2006.01) |
| ***H01P 1/202*** | (2006.01) |
| ***H01P 1/203*** | (2006.01) |
| ***H01P 11/00*** | (2006.01) |
| ***H01P 7/04*** | (2006.01) |

(52) U.S. Cl.

CPC ..... *H01P 1/202* (2013.01); *H01P 1/205* (2013.01); *H01P 1/20336* (2013.01); *H01P 7/04* (2013.01); *H01P 11/007* (2013.01)

(58) Field of Classification Search

CPC ..... H01P 1/202; H01P 1/203; H01P 1/20336; H01P 1/205; H01P 1/2053; H01P 7/04; H01P 7/06; H01P 7/08

USPC ..... 333/203, 204, 202, 205, 206, 207, 222, 333/223, 227

See application file for complete search history.

(56) References Cited

U.S. PATENT DOCUMENTS

| | | | |
|---|---|---|---|
| 3,597,709 | A | 8/1971 | Rhodes |
| 5,225,799 | A | 7/1993 | West et al. |
| 5,892,419 | A | 4/1999 | Kotanen et al. |
| 6,005,455 | A | 12/1999 | Lindell et al. |
| 2009/0128263 | A1 | 5/2009 | Hesselbarth |
| 2017/0084977 | A1 | 3/2017 | Niiranen |

FOREIGN PATENT DOCUMENTS

| | | | |
|---|---|---|---|
| CN | 1222257 | A | 7/1999 |
| CN | 200962447 | Y | 10/2007 |
| CN | 101276952 | A | 10/2008 |
| CN | 106463806 | B | 2/2017 |
| CN | 106463807 | A | 2/2017 |

(Continued)

OTHER PUBLICATIONS

Annex to European Search Report dated Jan. 10, 2019, issued in European Application No. 18189464, 1 page.

(Continued)

*Primary Examiner* — Stephen E. Jones

(74) *Attorney, Agent, or Firm* — Sage Patent Group

(57) ABSTRACT

A coaxial filter comprises a housing that surrounds a receiving space. The housing comprises a trough-shaped housing element with sidewalls and a front wall. The housing further comprises a further trough-shaped housing element, wherein the two trough-shaped housing elements are placed on top of one another, thus forming the receiving space; or a lid arrangement which, together with the trough-shaped housing element forms the receiving space. At least one resonator inner conductor arrangement comprises a connecting bridge, with which resonator inner conductors are conductingly connected.

18 Claims, 21 Drawing Sheets

(56) References Cited

FOREIGN PATENT DOCUMENTS

| | | | |
|---|---|---|---|
| DE | 43 30 491 | | 3/1995 |
| DE | 10 2004 010 683 | | 9/2005 |
| DE | 10 2016 104 608 | | 9/2017 |
| EP | 0201083 | A2 | 11/1986 |
| EP | 2287964 | A1 | 2/2011 |
| JP | S58-166803 | A | 10/1983 |
| KR | 20090021773 | A | 3/2009 |

OTHER PUBLICATIONS

First Office Action, Chinese Application No. 201810998761.9 dated Mar. 5, 2021, 21 pages.
Second Office Action, Chinese Application No. 201810998761.9 dated Oct. 18, 2021, 5 pages.

COAXIAL FILTER

CROSS-REFERENCE TO RELATED APPLICATION

This application claims priority to DE Patent Application No. 10 2017 119 907.1 filed Aug. 30, 2017, the entire contents of which are hereby incorporated by reference.

FIELD

The invention relates to a coaxial filter that is constructed with very few different parts in order to facilitate the production.

BACKGROUND & SUMMARY

In telecommunications and high frequency technology, filters are always used, when only specific frequency components of a signal are supposed to be processed. In addition to high-pass and low-pass filters, there are also bandpass or band-stop filters. Filters can be realized digitally or also constructed by means of discrete components. The filters can be assembled on a circuit board or designed as a coaxial filter in the form of milled or cast hollow structures. Filters with a coaxial design are frequently produced with a die casting method, wherein the fine adjustment can be executed by means of adjustment elements which can be additionally screwed in.

Such a filter, for example, is known from DE 10 2004 010 683 B3. However, such a filter has the disadvantage that the construction volume, particularly the height, is large. This results in problems in some areas of application.

A different high-frequency filter is known from DE 43 30 491 A1. This high-frequency filter comprises two continuous frames that are placed on top of one another and glued together. Between the two continuous frames, resonator inner conductors are inserted that are glued together with the continuous frames. The two lid arrangements close the high-frequency filter.

DE 43 30 491 A1 is disadvantageous because the structure requires the provision of very many components which overall does not result in high-precision reproducible electric properties during assembly.

Therefore, the technology herein addresses the problem of providing a coaxial filter that has an improved ratio of electric property to construction volume. In addition, this filter is supposed to be designed as simply and cost-efficiently as possible.

The coaxial filter according to example non-limiting technology herein comprises a housing that surrounds a common receiving space. The housing comprises an electrically conducting material and further has a trough-shaped housing element that comprises sidewalls and a front wall. The front wall closes off a space outwardly on one side between the sidewalls. The sidewalls are integral with the front wall. The housing further comprises a further trough-shaped housing element that comprises sidewalls, wherein a further space between these sidewalls is closed off on one of their sides by a further front wall. Once again, the sidewalls are integral with the front wall. Both trough-shaped housing elements are placed on top of one another, and so the sidewalls of both trough-shaped housing elements run between the two front walls and jointly surround or define the receiving space which is formed by the two spaces. Instead of a further trough-shaped housing element, the housing can alternatively comprise a lid arrangement, wherein the sidewalls of the trough-shaped housing element runs between the front wall and the lid arrangement, thus surrounding the receiving space formed by the space. In such case, the lid arrangement closes the receiving space.

The housing is designed to be preferably HF-tight. In addition, at least one resonator inner conductor arrangement with a one-piece design is provided which is arranged in the receiving space, and which preferably consists of or comprises a punched and/or lasered metal sheet. The at least one resonator inner conductor arrangement comprises a plurality of resonator inner conductors, wherein at least two or all of them lie in the same plane and have a first end and a second end spaced apart from the first end. The resonator inner conductors are aligned parallel or with one component predominantly parallel to the front wall or the lid arrangement. In addition, the resonator inner conductor arrangement comprises a connecting bridge, on which the individual resonator inner conductors are connected to one another with their first end in an electrically conducting manner, and from which they run away spaced apart from one another. Preferably, the resonator inner conductor arrangement consists exclusively of the plurality of resonator inner conductors and the connecting bridge. At least two adjacent resonator inner conductors, which extend in the same direction away from the common connecting bridge, are in the line of sight of one another over their entire length or over their predominant length, thus allowing for a direct coupling. This means that the housing is not adjusted to the contour of the resonator inner conductor arrangement and extends into the clearance between two adjacent resonator inner conductors. The term "entire length" refers to the length from the first to the second end. As a result, the housing can have a very simple geometry and can be produced in a simple and cost-efficient manner.

It is particularly advantageous that the housing can be produced more cost-efficiently than is the case for the housing from the prior art. The use of a trough-shaped housing element is advantageous in that it can be produced beforehand, i.e. prior to the final assembly, and the tolerances with regard to the respective sidewalls together with the front wall are many times smaller than the tolerances in a housing from the prior art. Due to the use of two separate side frames and two separate lid arrangements together with the adhesive bond, only insufficient manufacturing tolerances can be realized with said housing. With the solution described herein, the number of joining or contact or transition points between different housing elements and the resonator inner conductor arrangement is also reduced which can negatively influence the electric properties (slight losses or intermodulation). Thus, the number of possible points of interference or defect is reduced. The use of a further trough-shaped housing element allows for a symmetrical structure, wherein only one corresponding shape is required if the trough-shaped housing element is produced, for example, in a (die) casting process. The application with a lid arrangement is also advantageous because a very flat housing can be realized as a result. The use of the resonator inner conductor arrangement also facilitates the production because all resonator inner conductors are arranged at the common connecting bridge and the entire resonator inner conductor arrangement is produced as one piece. The resonator inner conductor arrangement can be produced in a separate process and measured with regard to its precise dimensions beforehand. Due to the flat design of the resonator inner conductor arrangement, it is optimally suitable for the use in the initially described housing. It is particularly advantageous that the coaxial filter is constructed of only three parts, resulting in a very low construction height. The coaxial filter can be produced in a casting process, particularly in an (aluminum or zinc) die casting process. It can also be produced in a milling process or with impact extrusion. Such a coaxial filter can be used particularly for a power from 5 to 20 watts. The power can also be lower or higher. The housing and/or the resonator inner conductor arrangement could also be made of plastic, wherein said plastic would have to be provided with an electrically conducting layer. The at least one resonator inner conductor arrangement preferably consists of a metal sheet that can be punched, lasered, milled, drilled and/or printed. The at least one resonator inner conductor arrangement can either be galvanically separated from the housing or galvanically connected to it. Preferably, the second end of the resonator inner conductor is held spaced apart from the housing, wherein the resonator inner conductor arrangement, particularly the individual resonator inner conductors, run centrally through the receiving space, and is spaced apart at equal distances from the front sides or the lid arrangement. The resonator inner conductor arrangement is particularly soldered and/or screwed and/or clamped but not glued to the housing (glue-free). A course outside from the center would also be possible.

The resonator inner conductor arrangement can provide a low-pass or bandpass or high-pass characteristic. It can also be an interconnected filter, with which a plurality of frequency ranges can be operated. The coaxial filter can be used as a diplexer or multiplexer or duplexer.

The resonator inner conductor arrangement preferably has a homogenous thickness which is preferably greater than 0.2 mm, 0.4 mm, 0.5 mm, 0.7 mm, 0.9 mm, 1 mm, 1.5 mm, 2 mm, 2.5 mm, 3 mm, but further preferably smaller than 5 mm, 4 mm, 3 mm, 2 mm, 1 mm, 0.8 mm, 0.6 mm. The surface of the upper side or underside of the resonator inner conductor arrangement is many times (more than 3, 5, 7, 9, 11, 13, 15, 17, 19 times) greater than the side surface of the resonator inner conductor arrangement.

In a further advantageous embodiment, the coaxial filter comprises a conducting separator which begins on each of the sidewalls of the two trough-shaped housing elements placed on top of one another or on the one trough-shaped housing element and extends in the direction of the opposite sidewall. As a result, the receiving space is divided into two receiving chambers which are connected to one another by an opening. The common connecting bridge of the resonator inner conductor arrangement preferably rests on the separator, and so the individual resonator inner conductors protrude into different receiving chambers. As a result, a duplexer with filter paths, which are predominantly decoupled from one another, can be created in a very advantageous manner.

A further embodiment is designed with an additional resonator inner conductor arrangement, wherein the one resonator inner conductor arrangement is fastened to the front wall of the trough-shaped housing element, and the further resonator inner conductor arrangement is fastened to the front wall of the further trough-shaped housing element (e.g. directly or above pedestal arrangements or spacers). An additional trough-shaped housing element could also be provided, wherein the front wall of the trough-shaped element is placed on the end faces of its sidewalls and which is closed with a lid arrangement, thus creating a further receiving space. The further resonator inner conductor arrangement is subsequently arranged in said further receiving space. In the front wall of the trough-shaped housing element, which is closed with the lid arrangement, at least one coupling opening is introduced, and so an electric coupling between the individual resonator inner conductors in the different receiving spaces is possible. As a result, the coaxial filter can be optionally expanded in order to be able to attach additional coupling and decoupling devices.

In another example non-limiting embodiment, a coaxial filter (1) comprises a housing (2) that surrounds a receiving space (5). The housing (2) comprises a trough-shaped housing element (2*a*) with sidewalls and a front wall. The housing (2) further comprises:

- a further trough-shaped housing element (2*b*), wherein the two trough-shaped housing elements (2*a*, 2*b*) are placed on top of one another, thus forming the receiving space; or
- a lid arrangement (2*c*) which, together with the trough-shaped housing element (2*a*) forms the receiving space.

A resonator inner conductor arrangement (6, 6*a*) is arranged in the receiving space (5). The at least one resonator inner conductor arrangement (6, 6*a*) comprises a plurality of resonator inner conductors (7*a*, . . . , 7*n*) that lie in the same plane. The at least one resonator inner conductor arrangement (6, 6*a*) comprises a connecting bridge (10), with which the resonator inner conductors (7*a*, . . . , 7*n*) are conductingly connected. At least two adjacent resonator inner conductors (7*a*, . . . , 7*n*) of the at least one resonator inner conductor arrangement (6, 6*a*), which extend away from the connecting bridge (10) in the same direction, are in the line of sight of one another over their entire length or over their predominant length. (FIG. 2)

BRIEF DESCRIPTION OF THE DRAWINGS

In the following, different embodiments shall be described exemplarily with reference to the drawings. The same objects are denoted with the same reference signs. In detail, the corresponding figures of the drawings show.

DETAILED DESCRIPTION OF NON-LIMITING EMBODIMENTS

Figure 1:
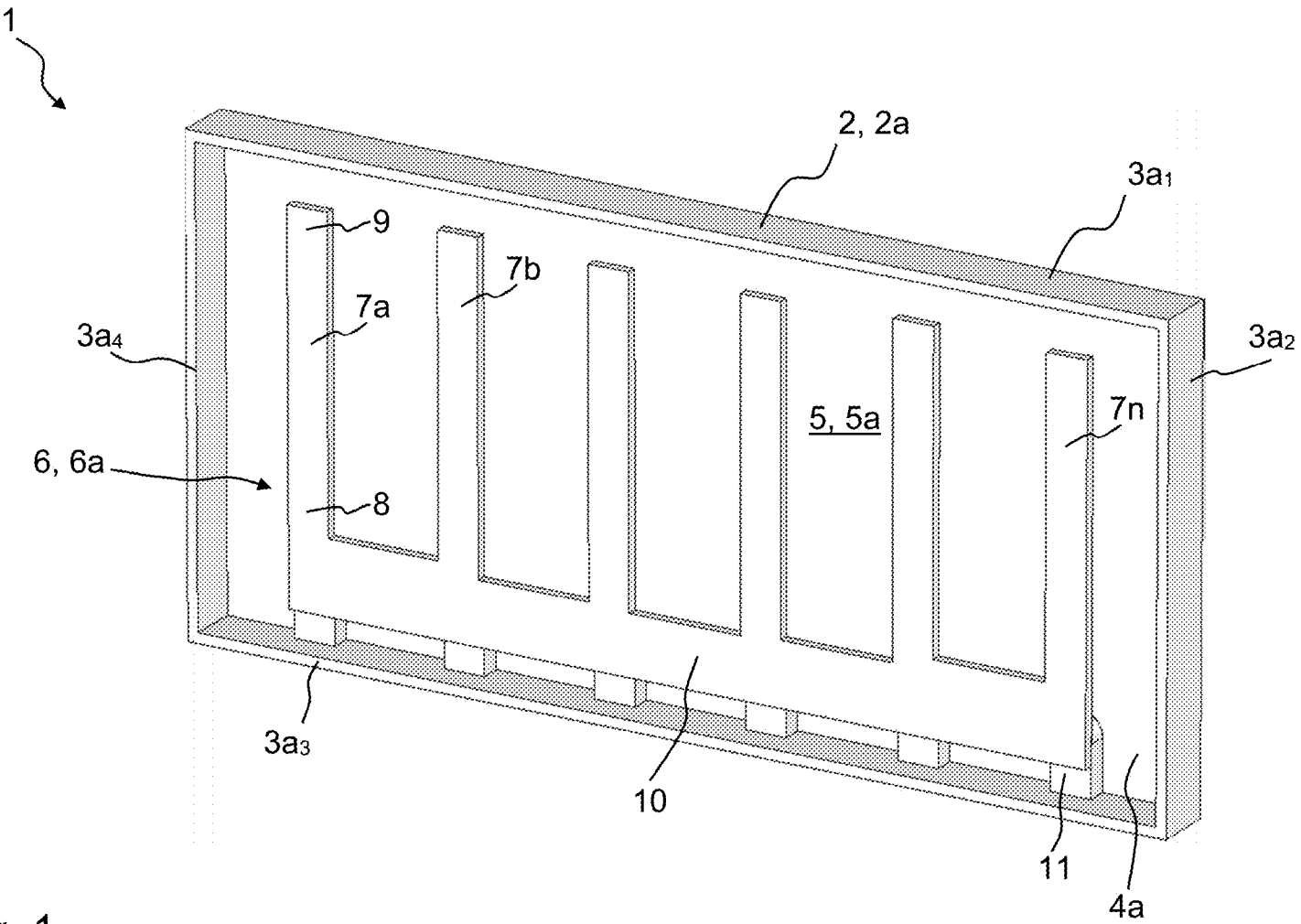
FIG. 1: a simplified depiction of the coaxial filter, showing a trough-shaped housing element, in which a resonator inner conductor arrangement is arranged.

FIG. 1 shows a simplified depiction of the coaxial filter 1. The coaxial filter 1 comprises a housing 2 that delimits a common receiving space 5. The housing 2 consists of an electrically conducting material and comprises a trough-shaped housing element 2*a* that comprises sidewalls $3a_1$, $3a_2$, $3a_3$, and $3a_4$. In addition, the trough-shaped housing element 2*a* also comprises a front wall 4*a*, wherein all sidewalls $3a_1$, $3a_2$, $3a_3$, and $3a_4$ are integral with the front wall 4*a*. On its one side, a space 5*a* is closed off by the front wall 4*a* between the sidewalls $3a_1$, $3a_2$, $3a_3$, and $3a_4$. The sidewalls $3a_1$, $3a_2$, $3a_3$, and $3a_4$ continuously surround the space 5*a* or the receiving space 5. Simultaneously, the sidewalls $3a_1$, $3a_2$, $3a_3$, and $3a_4$ are also the outer walls of the housing 2.

Figure 2:
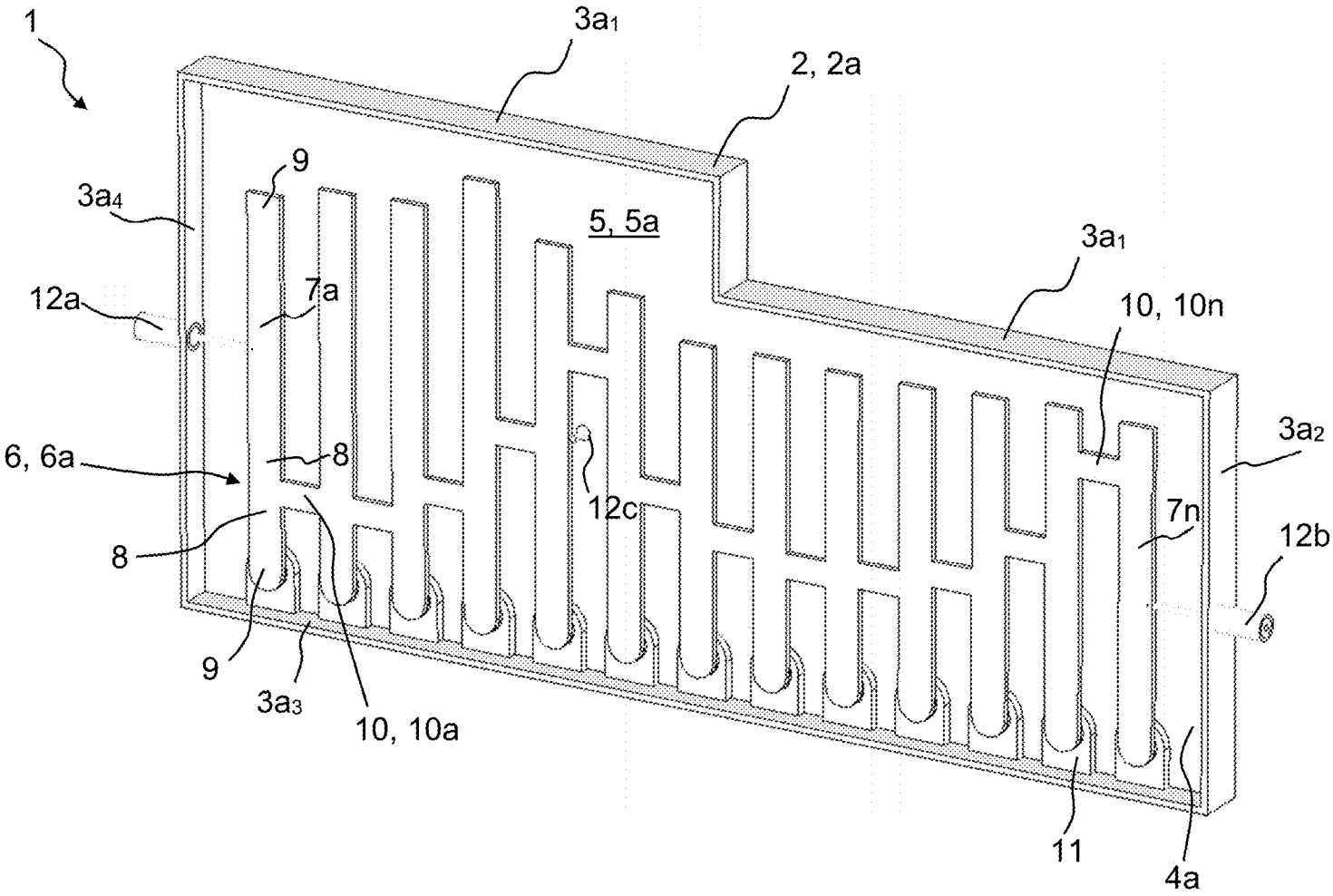
FIG. 2: a further simplified depiction of the coaxial filter, showing a different design of the resonator inner conductor arrangement, and in which three coupling and/or decoupling devices or coupling and/or decoupling connections can be seen.

In this case, the trough-shaped housing element 2*a* has a rectangular layout, particularly a longitudinal section. The sidewalls $3a_1$ to $3a_4$ preferably run perpendicularly to the front wall 4*a*. However, they can also run obliquely to the front wall 4*a*. In the depicted embodiment, the individual sidewalls $4a_1$ to $4a_4$ run at a right angle to one another. However, the corners thus formed can also be rounded. Other basic forms are also conceivable. In a top view of a longitudinal section, the coaxial filter 1 can also be designed so as to be square, oval, or circular. The individual side walls $4a_1$ to $a_4$ can also have a stepped profile as is shown in FIG. 2. The trough-shaped housing element 2*a* consists of a material or comprises a material that is electrically conducting.

Figure 5A:
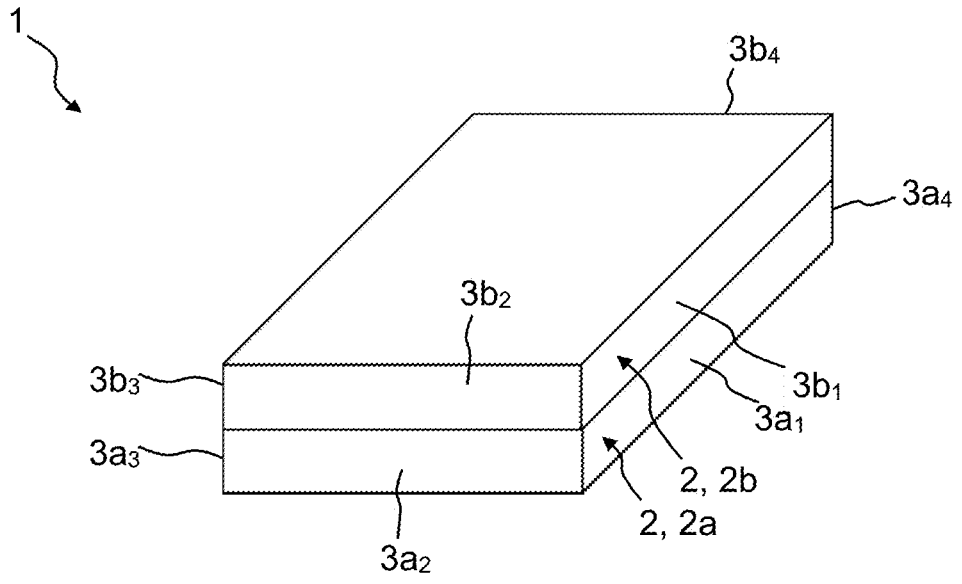
FIGS. 5A, 5B: two different embodiments of the housing of the coaxial filter.

FIG. 1 shows the opened housing 2. However, for the proper operation of the coaxial filter 1, it must be closed. This can be achieved with two options. In a first option, it is provided that a further trough-shaped housing element 2*b* is used which is preferably designed identically to the already described trough-shaped housing element 2*a*. The further trough-shaped housing element 2*b*, which, e.g. is shown in FIG. 5A, also comprises (continuous) sidewalls $3b_1$, $3b_2$, $3b_3$, and $3b_4$ and a front wall 4*b*, wherein a further space 5*b* is closed off on its one side by the front wall 4*b* between the sidewalls $3b_1$, $3b_2$, 3*b*3, and $3b_4$. The sidewalls $3b_1$, $3b_2$, 3*b*3, and $3b_4$ are integral with the front wall 4*b*. The front wall 4*b* of the further trough-shaped housing element 2*b* thus closes off the further space 5*b* between the sidewalls $3b_1$, $3b_2$, 3*b*3, and $3b_4$ on their one side (front side). Simultaneously, the sidewalls $3b_1$, $3b_2$, 3*b*3, and $3b_4$ are also the outer walls of the housing 2.

The two trough-shaped housing elements 2*a*, 2*b* are placed on top of one another with their open side facing one another. Preferably, the front sides of the side walls $3a_1$ to $3a_4$ and $3b_1$ to $3b_4$ of both trough-shaped housing elements 2*a*, 2*b* contact one another. The sidewalls $3a_1$ to $3a_4$ and $3b_1$ to $3b_4$ of both trough-shaped housing elements 2*a*, 2*b* run between the corresponding front walls 4*a*, 4*b*, thus delimiting the receiving space 5 which is formed by the two spaces 5*a*, 5*b*. A housing 2 assembled such can be seen, for example, in FIG. 5A. Both trough-shaped housing elements 2*a*, 2*b* are preferably screwed and/or soldered together. The housing elements 2*a*, 2*b* can also be connected differently (galvanically). Depending on the requirement regarding outward shielding, the connection does not necessarily have to be galvanic. The housing elements 2*a*, 2*b* can also be connected in a moisture-proof manner.

Figure 5B:
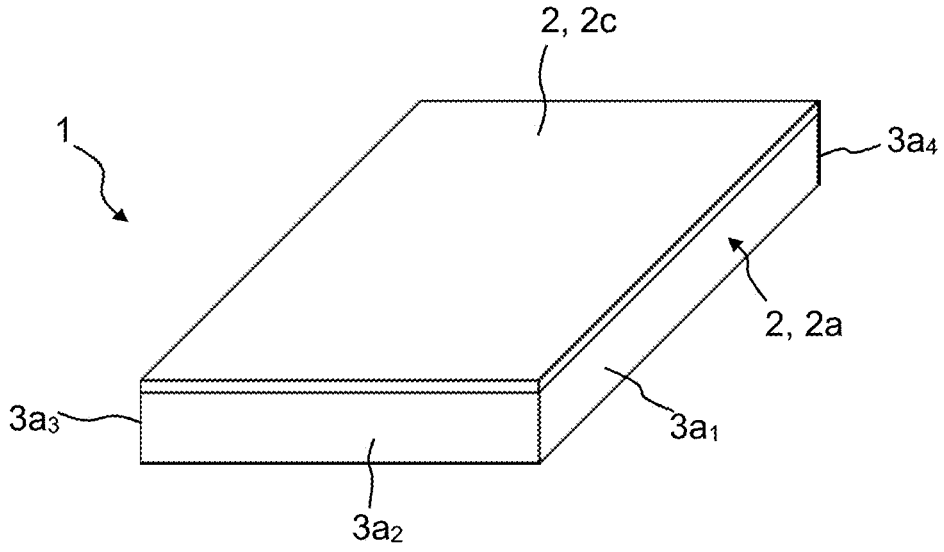

Instead of a further trough-shaped housing element 2*b*, the one trough-shaped housing element 2*a* can also be closed with a lid arrangement 2*c*, wherein the sidewalls $3a_1$ to $3a_4$ run between the front wall 4*a* and the lid arrangement 2*c* and delimit the receiving space 5 which is formed by the space 5*a*. Such a design of the housing 2 can be seen, for example, in FIG. 5B. The lid arrangement 2*c* is preferably designed as one piece and similarly to the trough-shaped housing element 2*a* also consists of an electrically conducting material. The lid arrangement 2*c* could basically also consist of a dielectric material which is coated at least on one side with an electrically conducting layer. A lid arrangement 2*c* is preferably plate-shaped and itself does not surround any space. It extends in only one plane.

In FIG. 1, at least one resonator inner conductor arrangement 6, 6*a* is additionally provided which is designed as one piece and arranged in the receiving space 5. The at least one resonator inner conductor arrangement 6, 6*a* comprises a plurality of resonator inner conductors 7*a*, 7*b*, . . . 7*n* with n≥2, 3, 4, 5, 6, 7, 8, 9, 10 and n element of the natural numbers which preferably all lie in the same plane. The resonator inner conductors 7*a* to 7*n* each comprise a first end 8 and a second end 9 spaced apart from the first end 8. The resonator inner conductors 7*a* to 7*n* run with one component parallel or predominantly parallel to a front wall 4*a*, 4*b* or the lid arrangement 2*c*.

The at least one resonator inner conductor arrangement 6, 6*a* also comprises a (common) connecting bridge 10, at which the resonator inner conductors 7*a* to 7*n* are connected in an electrically conducting manner with their first end 8. The individual resonator inner conductors 7*a* to 7*n* run parallel to one another and parallel to at least one sidewall $3a_2$ or $3a_4$.

The resonator inner conductor arrangement 6, 6*a* is particularly free of a surrounding frame, in which the plurality of resonator inner conductors 7*a*, 7*b*, . . . 7*n* and the connecting bridge 10 is arranged and which is integral with the connecting bridge 10.

The connecting bridge 10 of the resonator inner conductor arrangement 6, 6*a* runs for over more than 60%, 70%, 80%, 90%, or 95% along and parallel to the length of a sidewall $3a_1$, $3a_2$, $3a_3$, and $3a_4$, which also forms an outer wall. In particular, the receiving space 5 extends over the entire length and/or width of the coaxial filter 1 (minus the thickness of the respective sidewall $3a_1$, $3a_2$, $3a_3$, and $3a_4$).

The individual resonator inner conductors 7*a* to 7*n* are spaced apart from one another by a predefined distance. At least two adjacent resonator inner conductors 7*a* to 7*n*, which extend away from the connecting bridge 10 in the same direction, are in the line of sight of one another over their entire length or over their predominant length (more than 50%, 60%, 70%, or 80%). This means that the housing 2 is just not immersed in the clearance between two adjacent resonator inner conductors 7*a* to 7*n* which would greatly reduce the coupling between two adjacent resonator inner conductors 7*a* to 7*n*.

In FIG. 1, all resonator inner conductors 7*a* to 7*n* extend away from the same side of the connecting bridge 10. The connecting bridge 10 preferably runs parallel to a sidewall $3a_1$ or $3a_3$ of the trough-shaped housing element 2*a*. Der connecting bridge 10 is preferably arranged closer to a sidewall $3a_3$, to which it runs parallel, or with one component predominantly parallel, than to another sidewall $3a_1$, to which it also runs parallel or predominantly parallel.

The connecting bridge has length that preferably corresponds to more than 50%, 60%, 70%, 80%, or 90% of the length of the sidewall $3a_1$ or $3a_3$, to which it runs parallel. However, the connecting bridge 10 is preferably shorter than the corresponding sidewall $3a_1$ or $3a_3$, to which it runs parallel.

The width of the connecting bridge 10 is preferably greater than the width of at least one or all of the resonator inner conductors 7*a* to 7*n*. However, it could also be equal or smaller.

In FIG. 1, the width of the connecting bridge 10 is greater at the beginning and the end of the connecting bridge 10 than in an area between the beginning and the end of the connecting bridge 10.

The resonator inner conductor arrangement 6, 6*a* consists of a punched and/or lasered and/or curved and/or milled and/or printed metal sheet. A carrier material for the actual filter structure, as is used in microstrip structures, is not required. This means that the resonator inner conductor arrangement 6, 6*a* is free of carrier material. Due to the omission of a carrier material, the electric losses are also reduced and the filter is thus improved. In particular, the resonator inner conductor arrangement 6, 6*a* is circuit board-free.

The resonator inner conductor arrangement 6, 6*a* preferably consists of a different material than the housing 2. It could also consist of the same material, such as aluminum. However, the resonator inner conductor arrangement 6, 6*a* and the housing 2 do not consist of the same part or workpiece. They thus consist of different workpieces. They are not integral with one another. They are produced in separate processes. The resonator inner conductor arrangement 6, 6*a* and the trough-shaped housing element 2*a* or 2*b* or the lid arrangement 2*c* are not produced from a common workpiece or part. This means that the resonator inner conductor arrangement 6, 6*a* is produced separately and inserted in the receiving space 5 of the housing 2. The insertion of the resonator inner conductor arrangement 6, 6*a* into the one trough-shaped housing element 2*a* is only possible via one opening which is closed by the further trough-shaped housing element 2*b* or the lid arrangement 2*c*. All other openings for insertions are closed by the sidewalls $3a_1$, $3a_2$, $3a_3$, and $3a_4$ and the front wall 4*a*.

The resonator inner conductor arrangement 6, 6*a* is held spaced apart from the front sides 4*a*, 4*b* or the lid arrangement 2*c*. In particular, the resonator inner conductors 7*a* to 7*n* are held spaced apart from the housing 2, particularly from the front walls 4*a*, 4*b* or the lid arrangement 2*c*.

The resonator inner conductor arrangement 6, 6*a* is arranged in the receiving space 5 which is directly surrounded by the sidewalls $3a_1$, $3a_2$, $3a_3$, and $3a_4$ or $3b_1$, $3b_2$, 3*b*3, and $3b_4$. The receiving space 5 always comprises boundary walls which are the sidewalls $3a_1$, $3a_2$, $3a_3$, and $3a_4$ or $3b_1$, $3b_2$, 3*b*3, and $3b_4$ and which are also the outer walls of the housing 2.

Figure 3A:
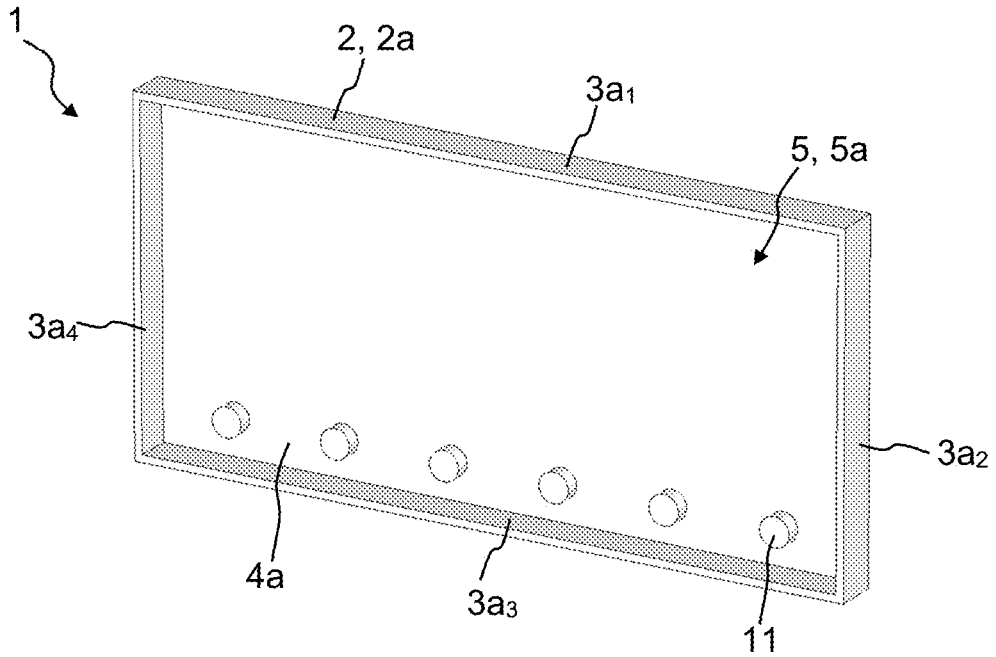
FIGS. 3A to 3D: different embodiments of a pedestal arrangement, on which the resonator inner conductor arrangement rests.
Figure 3B:
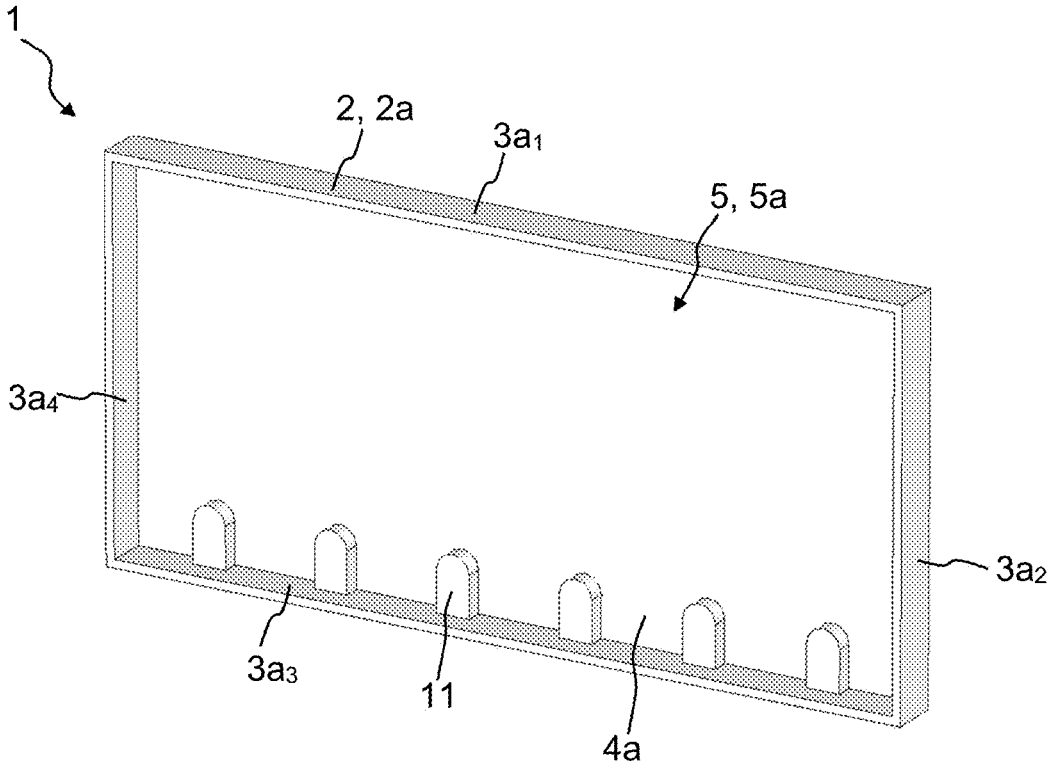

As shall be explained further below, the at least one resonator inner conductor arrangement 6, 6*a* is preferably soldered and/or screwed and/or clamped to the housing 2. Preferably, this is a galvanic connection. However, this is not obligatory. For example, the resonator inner conductor arrangement 6, 6*a* can also rest on a pedestal arrangement 11. Such a pedestal arrangement 11 shall be explained in detail with regard to FIGS. 3A to 3D. In FIGS. 3A and 3B, the pedestal arrangement 11 comprises a plurality of individual pedestals spaced apart from one another. The pedestal arrangement 11 comprises a dielectric material and/or an electrically conducting material. Basically, the dielectric material could also be coated with an electrically conducting layer, or vice versa. In FIG. 3A, the pedestal arrangement 11, consisting of a plurality of individual pedestals with a cross-section having a round shape, is integral with at least one front wall 4*a*, 4*b*. The individual pedestals are arranged at a distance from the sidewalls $3a_1$, $3a_2$, $3a_3$, $3a_4$. Basically, they can also be formed on the lid arrangement 2*c*. In such case, the individual pedestals are arranged preferably at an equal distance from one another. Preferably, the resonator inner conductor arrangement 6, 6*a* does not contact the housing 2 and is only held spaced apart from the housing 2 by the pedestal arrangement 11.

In FIG. 3B, said individual pedestals also have an extension in the direction of the corresponding sidewall $3a_1$ to $3a_4$ or $3b_1$ to $3b_4$. The pedestal arrangement 11 shown in FIG. 3B is preferably integral with the corresponding sidewall $3a_1$ to $3a_4$ or $3b_1$ to $3b_4$ of the at least one trough-shaped housing element 2*a* or 2*b*. In addition, it can be integral with the corresponding front wall 4*a* or 4*b*. In such case, the pedestal arrangement 11 is made of the same electrically conducting material as the trough-shaped housing elements 4*a*, 4*b*.

Figure 3C:
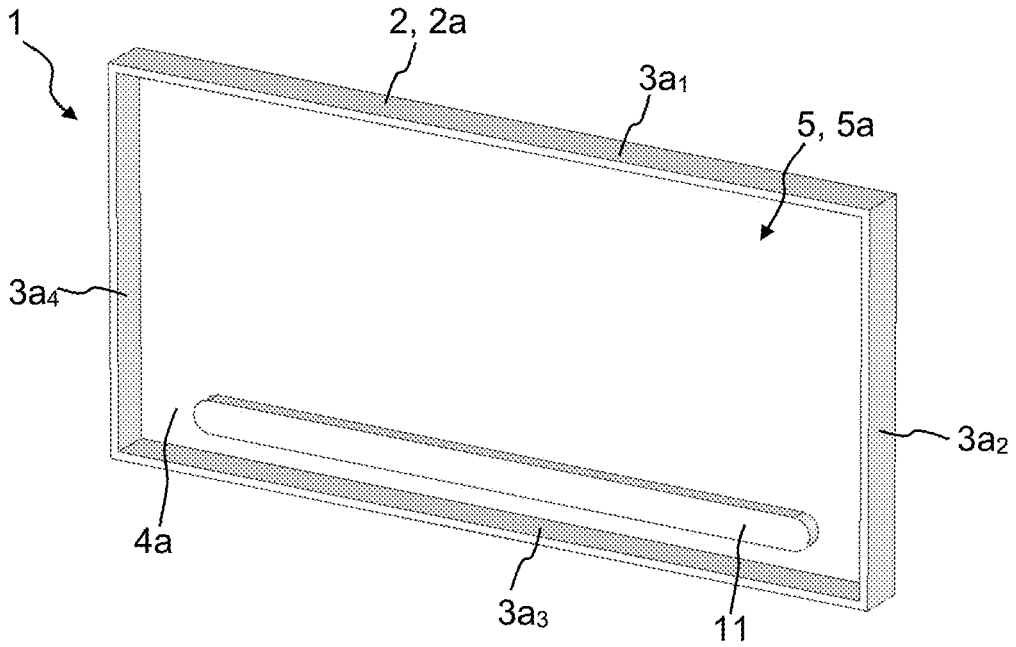

In FIG. 3C, the pedestal arrangement 11 comprises a continuous pedestal which extends over and along at least 50% of the length of the sidewall $3a_1$ or $3a_3$ or $3b_1$, $3b_3$. The continuous pedestal extends parallel or with one component predominantly parallel to the corresponding sidewall $3a_1$, $3a_3$ or $3b_1$, $3b_3$.

Figure 3D:
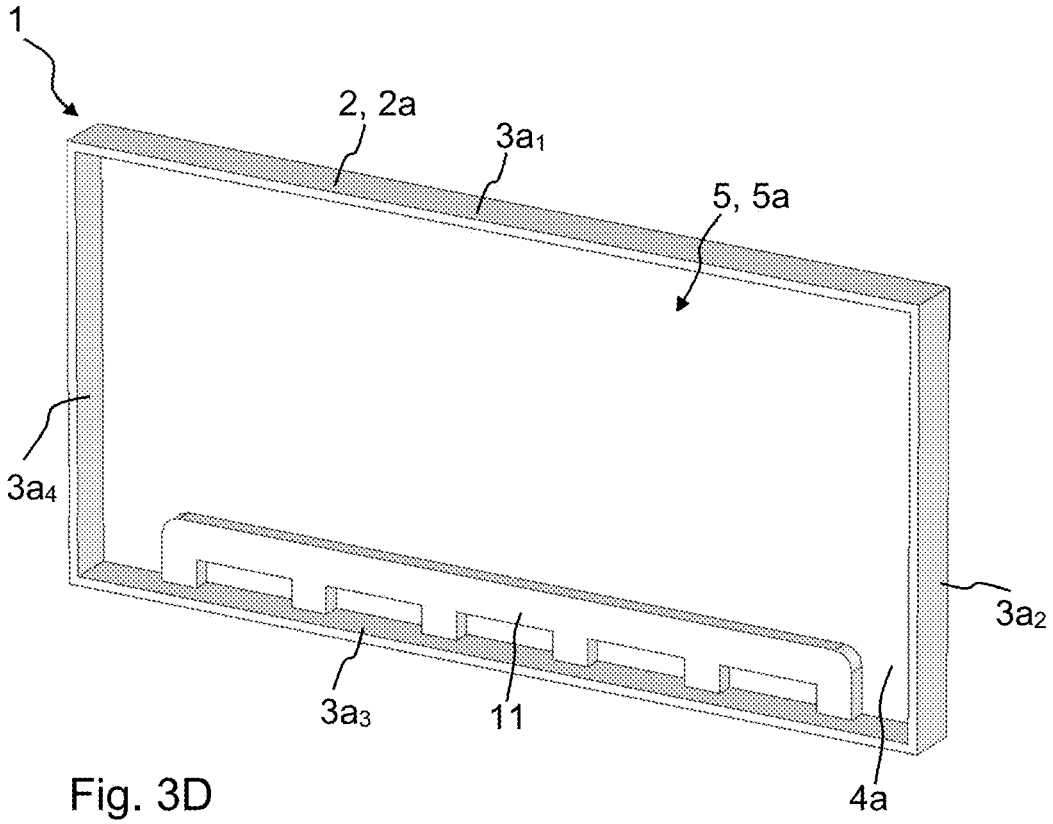

FIG. 3D combines the embodiments of FIG. 3B and 3C. The continuous pedestal from FIG. 3C, which is arranged at a distance from the sidewalls $3a_1$ to $3a_4$ or $3b_1$ to $3b_4$, is by means of connecting segments additionally connected galvanically to and is particularly integral with at least one sidewall $3a_1$ to $3a_4$ or $3b_1$ to $3b_4$. This pedestal arrangement 11 is preferably also integral with the front wall 4*a* and/or at least one sidewall 3*a*1 to 3*a*4 of the trough-shaped housing element 2*a* or with the front wall 4*b* and/or at least one sidewall 3*b*1 to 3*b*4 of the further trough-shaped housing element 2*b*.

In this case, the at least one resonator inner conductor arrangement 6, 6*a* rests on the at least one pedestal arrangement 11. Preferably, the resonator inner conductor arrangement 6 rests on the pedestal arrangement 11 only with its connecting bridge 10. This situation is shown, for example, in FIG. 1.

FIG. 2 shows a further embodiment of the coaxial filter 1. In this embodiment, the common connecting bridge 10 of the resonator inner conductor arrangement no longer runs along a straight line but is divided into different connecting bridge sections 10*a* to 10*n*, wherein the individual connecting bridge sections run offset, but preferably parallel, and further preferably in one plane to one another. This means that the individual connecting bridge sections 10*a* to 10*n* are spaced apart at different distances from the sidewalls $3a_1$, $3a_3$ or $3b_1$, $3b_3$, to which they run parallel or with one component predominantly parallel. It is also shown that at least two or all resonator inner conductors 7*a* to 7*n*, which, proceeding from the common connecting bridge 10, extending in the same direction, have different lengths.

In FIG. 2, the resonator inner conductors 7*a* to 7*n* of the at least one resonator inner conductor arrangement 6, 6*a* extend on both sides away from the connecting bridge 6.

In FIG. 2, the resonator inner conductor arrangement 6, 6*a* does not rest on the at least one pedestal arrangement 11 with its connecting bridge 10 but with its second end 9 of those resonator inner conductors 7*a* to 7*n* that extend along one direction away from the common connecting bridge 10. However, it would also be possible that the connecting bridge 10 rests on the at least one pedestal arrangement 11.

The resonator inner conductors 7*a* to 7*n*, which extend along one direction away from the common connecting bridge 10, are, along a partial length of the connecting bridge 10, spaced apart at different distances from the sidewall $3a_1$ or $3b_1$ toward which they extend, while, at a different partial length of the connecting bridge 10, from which they protrude, they are spaced apart at equal distances from the corresponding sidewall $3a_1$ or $3b_1$ toward which they extend. In addition, those resonator inner conductors 7*a* to 7*n*, which extend away on another side of the common connecting bridge 10 in the direction of the corresponding sidewall $3a_3$ or $3b_3$, are spaced apart from said sidewall $3a_3$ or $3b_3$ at equal distances.

In FIG. 2, a first, a second, and a third coupling and/or decoupling device 12*a*, 12*b*, and 12*c* are provided which are arranged at different points of the housing 2 and protrude from the outside of the housing 2 into the receiving space 5 and establish a capacitive or inductive or galvanic or predominantly capacitive or predominantly inductive or predominantly galvanic coupling to different resonator inner conductors 7*a* to 7*n* of the at least one resonator inner conductor arrangement 6, 6*a*.

Two of these coupling and/or decoupling devices 12*a*, 12*b* penetrate a sidewall 3*a*1 to 3*a*4 or 3*b*1 to 3*b*4, while the third coupling and/or decoupling device 12*c* penetrates a front wall 4*a* or 4*b* or the lid arrangement 2*c*. The first and the second coupling and/or decoupling device 12*a*, 12*b* are preferably coupled with the resonator inner conductors 7*a*, 7*n* which are arranged at the beginning and the end of the common connecting bridge 10. The third coupling and/or decoupling device 12*c*, which is arranged preferably perpendicularly to the other coupling and/or decoupling devices 12*a*, 12*b*, is coupled with a resonator inner conductor that is located between the outermost resonator inner conductors 7*a*, 7*n* (particularly in the middle).

The distance of the individual coupling and/or decoupling devices 12*a*, 12*b*, 12*c* to the corresponding resonator inner conductor is preferably less than 5 cm, 4 cm, 3 cm, 2*c* m, 1 cm, 0.5 cm. The coaxial filter 1 preferably operates as a duplex filter.

The coupling and/or decoupling devices 12*a*, 12*b*, 12*c* can also be called coupling and/or decoupling connections 12*a*, 12*b*, 12*c*. They are preferably sockets or plugs that are placed from the outside and screwed onto the housing 2. Preferably, no circuit board is arranged between the coupling and/or decoupling devices 12*a*, 12*b*, 12*c* and the at least one resonator inner conductor arrangement 6, 6*a*.

In the following, FIGS. 4A to 4J shall be described which show different embodiments of the resonator inner conductor arrangement 6, 6*a*.

At least one or all of the resonator inner conductors 7*a* to 7*n* of the at least one resonator inner conductor arrangement 6, 6*a* extend obliquely away from the common connecting bridge 10. The smaller angle α between the resonator inner conductors 7*a* to 7*n* and the common connecting bridge 10 is greater than 10°, 20°, 30°, 40°, 50°, 60°, 70°, 80°, but smaller than 85°, 75°, 65°, 55°, 45°, 35°, 25°, 15°, 5°. Each of the resonator inner conductors 7*a* to 7*n* can be divided into individual sections which in turn run toward one another at an angle. In such case, the corresponding resonator inner conductors would be bent. However, all of these sections run toward the connecting bridge 10 at an angle smaller than 90°.

Figure 4A:
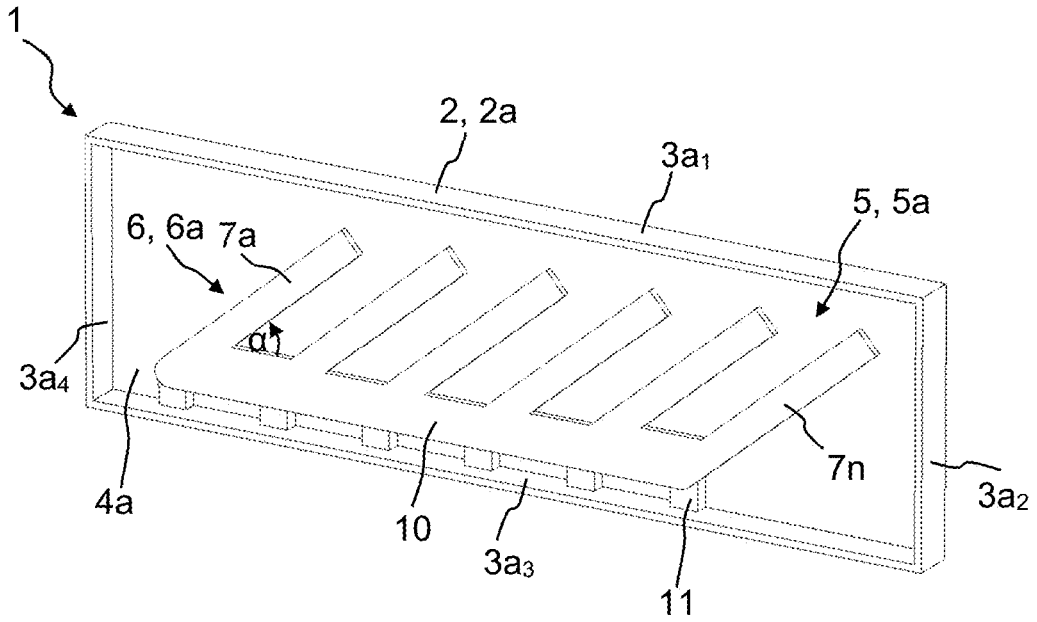
FIGS. 4A to 4J: different embodiments of the resonator inner conductor arrangement.
Figure 4B:
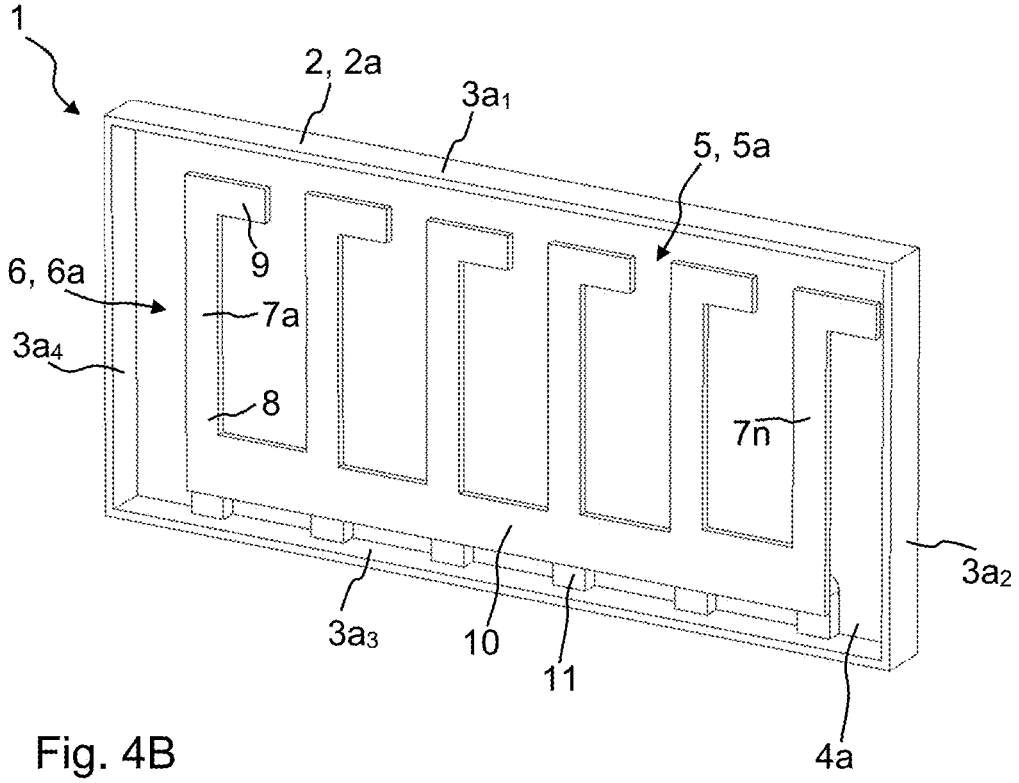

In FIG. 4B, the resonator inner conductors 7*a* to 7*n* run at a right angle away from the connecting bridge 10, wherein all have the same length. The second end 9 of at least one or all resonator inner conductors 7*a* to 7*n* runs angled (e.g. 90°). The angled section runs preferably parallel to the side wall $3a_1$ or $3a_3$ or $3b_1$ or $3b_3$, in the direction of which the individual resonator inner conductors 7*a* to 7*n* extend from the common connecting bridge 10. The angling makes it possible that the electrically active length of the resonator inner conductors 7*a* to 7*n*, which co-determine the respective resonance frequencies and thus the frequency range of the coaxial filter 1, stays the same, while the sidewalls $3a_2$ and $3a_4$ (or $3b_2$ and $3b_4$) can become shorter, and the installation space of the coaxial filter 1 can be reduced in this dimension.

According to FIG. 4B, the resonator inner conductors 7*a* to 7*n* have an L-shape, or approximate such a shape. The angled section runs for all resonator inner conductors in the same direction. The angled section of two adjacent resonator inner conductors 7*a* to 7*n* could also face the corresponding adjacent section, as is shown in 4I. As a result, an increased (capacitive) coupling is generated at the second end 9 of two adjacent resonator inner conductors 7*a* to 7*n*. The two ends 9 of two adjacent resonator inner conductors 7*a* to 7*n* thus run toward one another.

Basically, it would also be possible that the angled sections with the second end 9 of the resonator inner conductors 7*a* to 7*n* also run at an angle unequal 90° with regard to the remaining section of the resonator inner conductor 7*a* to 7*n*.

Figure 4C:
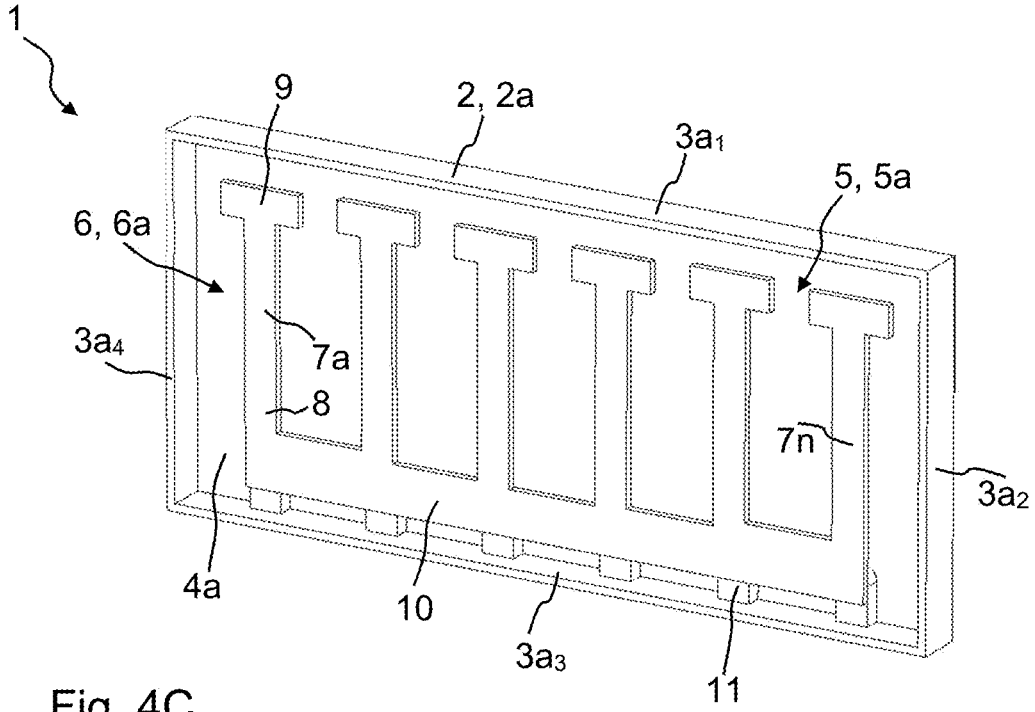

FIG. 4C shows that the second end 9 of at least one, preferably all resonator inner conductors 7*a* to 7*n* runs twice angled, and the corresponding resonator inner conductor 7*a* to 7*n* has particularly a T-shape or approximates such a shape. Both sections of the resonator inner conductor 7*a* to 7*n* thus run in the direction of two opposite sidewalls $3a_2$, $3a_4$ or $3b_2$, $3b_4$. This not only increases the capacitive coupling between the individual adjacent resonator inner conductors 7*a* to 7*n*, but also increases the capacitive coupling to the housing 2.

Figure 4D:
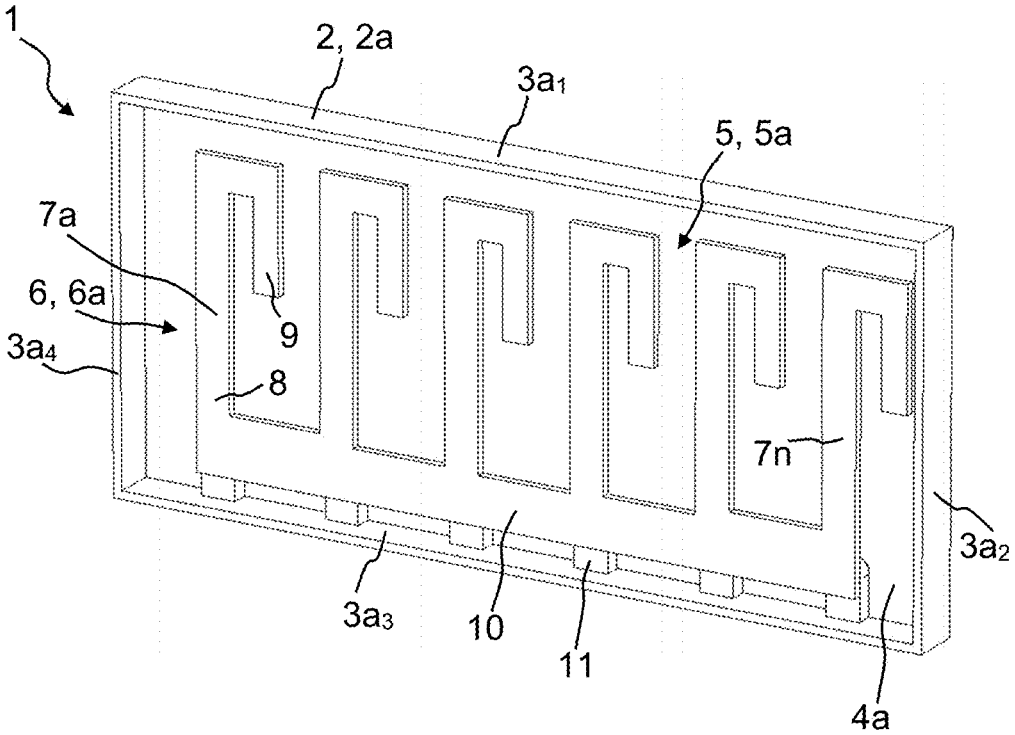

FIG. 4D also shows that the second end 9 of at least one or all resonator inner conductors 7*a* to 7*n* has a twice angled shape. In this case, the resonator inner conductors 7*a* to 7*n* have a U-shape or approximate such a shape. This means that the second end 9 of the resonator inner conductor runs back in the direction of the first end 8. This increases the electric length of the individual resonator inner conductor. Simultaneously, the coupling between two adjacent resonator inner conductors 7*a* to 7*n* and the coupling to the housing 2 is increased.

Figure 4E:
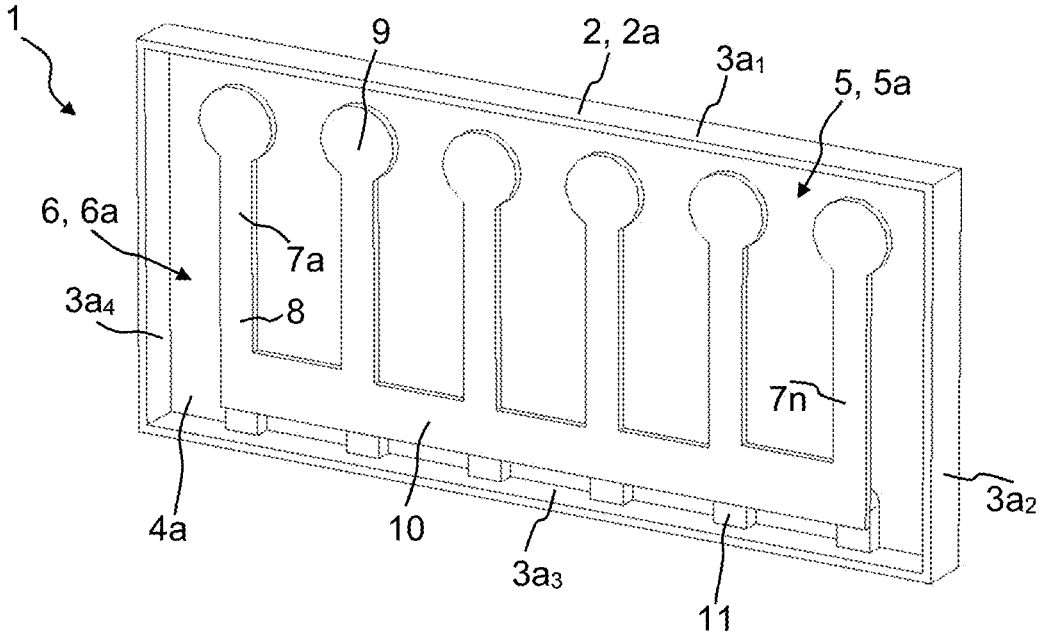

FIG. 4E shows that the second end 9 of at least one or all resonator inner conductors 7*a* to 7*n* has an enlarged section. In particular, the second end 9 has an enlarged width which from a top view is designed so as to be circular or at least approximates a circular shape. The second end 9 can also be widened squarely, hexagonally, or in any other manner.

Figure 4F:
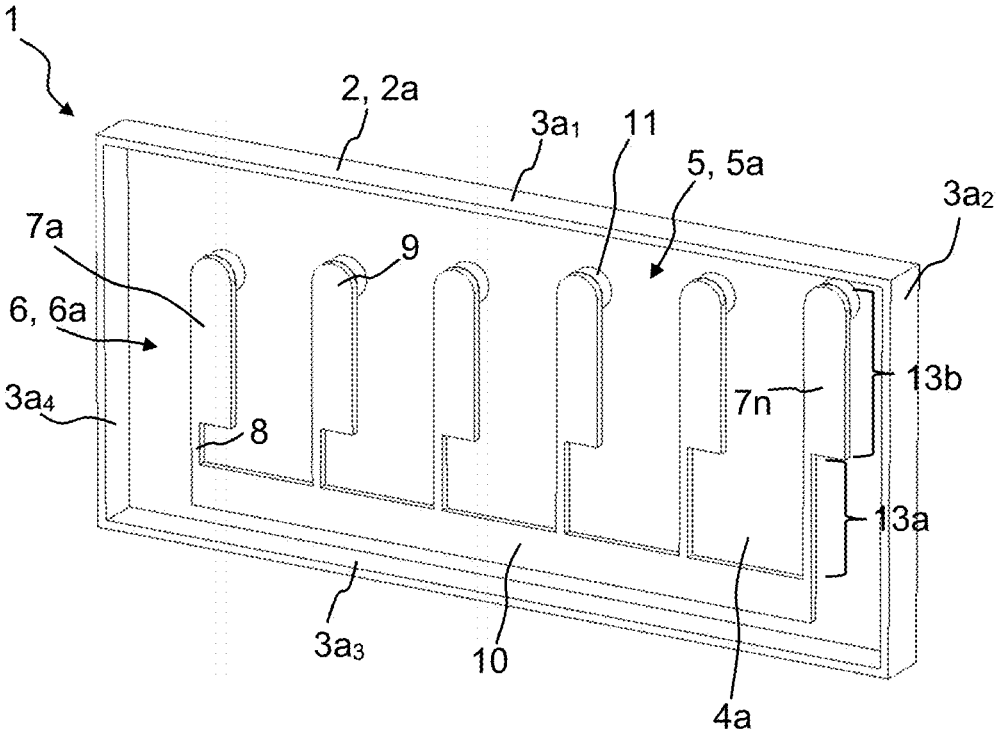

FIG. 4F shows a resonator inner conductor arrangement 6, 6*a*, through which the coaxial filter operates as a band-stop filter. At least two resonator inner conductors 7*a* to 7*n* or all resonator inner conductors 7*a* to 7*n* of the at least one resonator inner conductor arrangement 6, 6*a* have over a first partial length 13*a*, preferably beginning at the first end 8, a smaller width than over a second partial length 13*b*, which preferably ends at the second end 9. Both partial lengths 13*a*, 13*b* combined preferably result in the overall length of the resonator inner conductor 7*a* to 7*n*. For at least two or all resonator inner conductors 7*a* to 7*n*, the first partial length 13*a* can have a different length. The same can also apply to the second partial length 13*b*. The first partial length 13*a* or the second partial length 13*b* can also have the same length for all resonator inner conductors 7*a* to 7*n*. Over the second partial length 13*b*, the resonator inner conductor 7*a* to 7*n* is approximately more than 1.5 or 2 or 2.5 or 3 or 3.5 or 4 times wider than is the case with the first partial length 13*a*.

It basically also applies that the common connecting bridge 10 is approximately as wide as the resonator inner conductor 7*a* to 7*n*. The term "approximately" means that a deviation of less than 25%, 20%, 15%, 10%, or less than 5% is included.

Figure 4G:
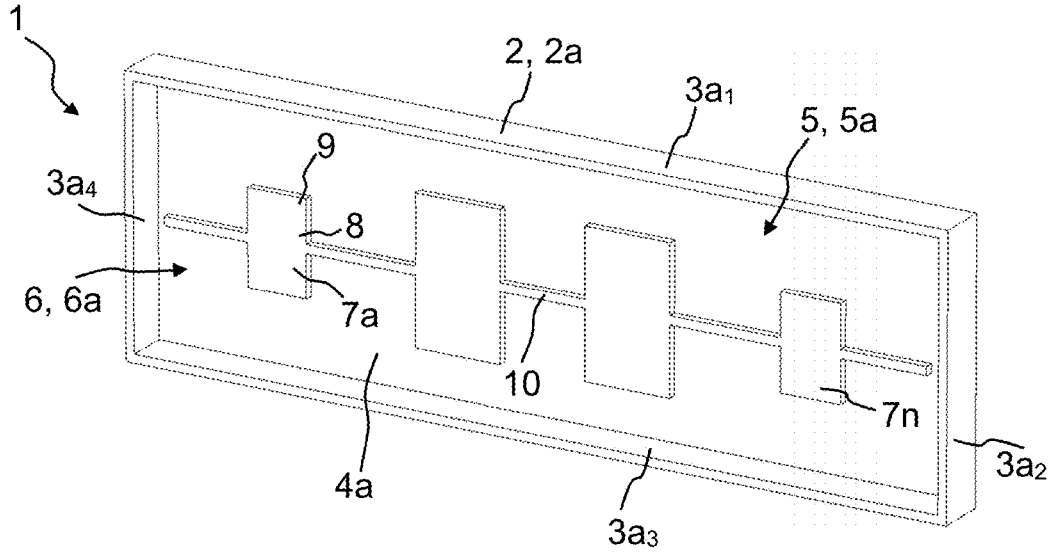

FIG. 4G shows a resonator inner conductor arrangement 6, 6*a*, through which the coaxial filter 1 can be operated as a low-pass filter. In this case, the at least one resonator inner conductor arrangement 6, 6*a* is designed so as to be mirror-symmetric, wherein the mirror axis runs through the connecting bridge 10, and wherein the connecting bridge 10 is many times narrower than the resonator inner conductors 7*a* to 7*n*. Such a mirror-symmetric arrangement means that the resonator inner conductors 7*a* to 7*n* run on two sides from the common connecting bridge 10 in the direction of the opposite sidewall $3a_1$, $3a_3$ or $3b_1$, $3b_3$. The length of at least two resonator inner conductors 7*a* to 7*n* is different. The same also applies to the width of at least two resonator inner conductors 7*a* to 7*n*. The distance of two adjacent resonator inner conductors 7*a* to 7*n* can also be different. A design that is not mirror-symmetric would also be possible. The resonator inner conductor arrangement 6, 6*a* rests on a pedestal arrangement 11 (not depicted), which in this case consists of or comprises a dielectric material.

Figure 4H:
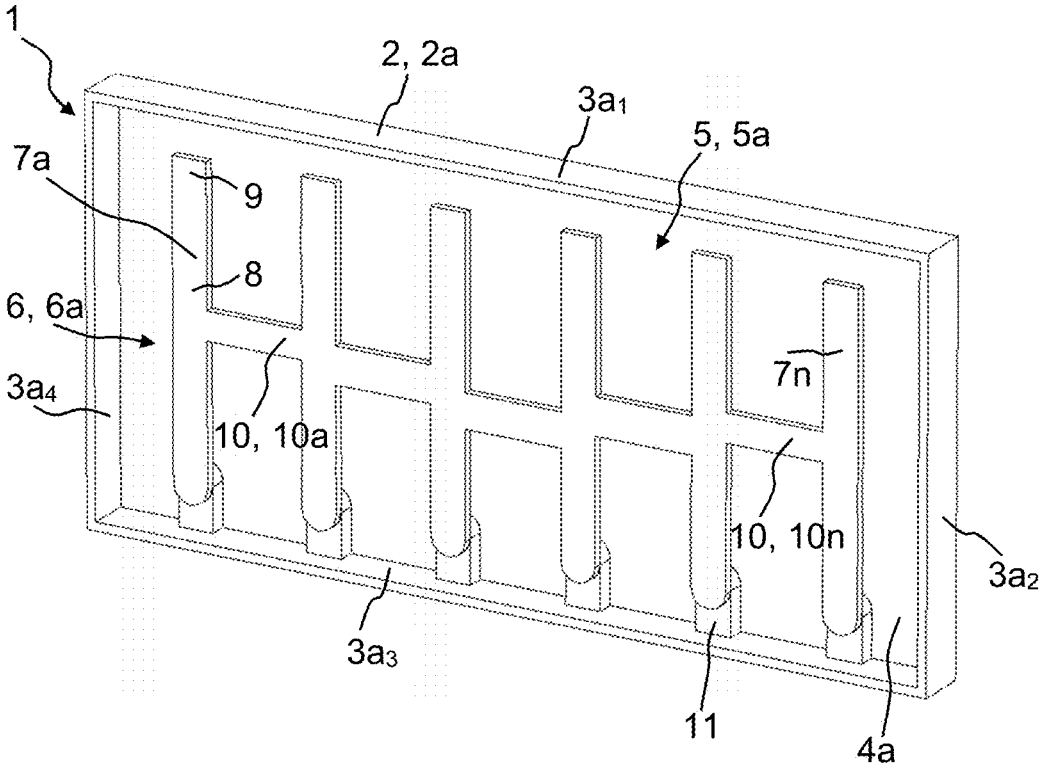
Figure 4I:
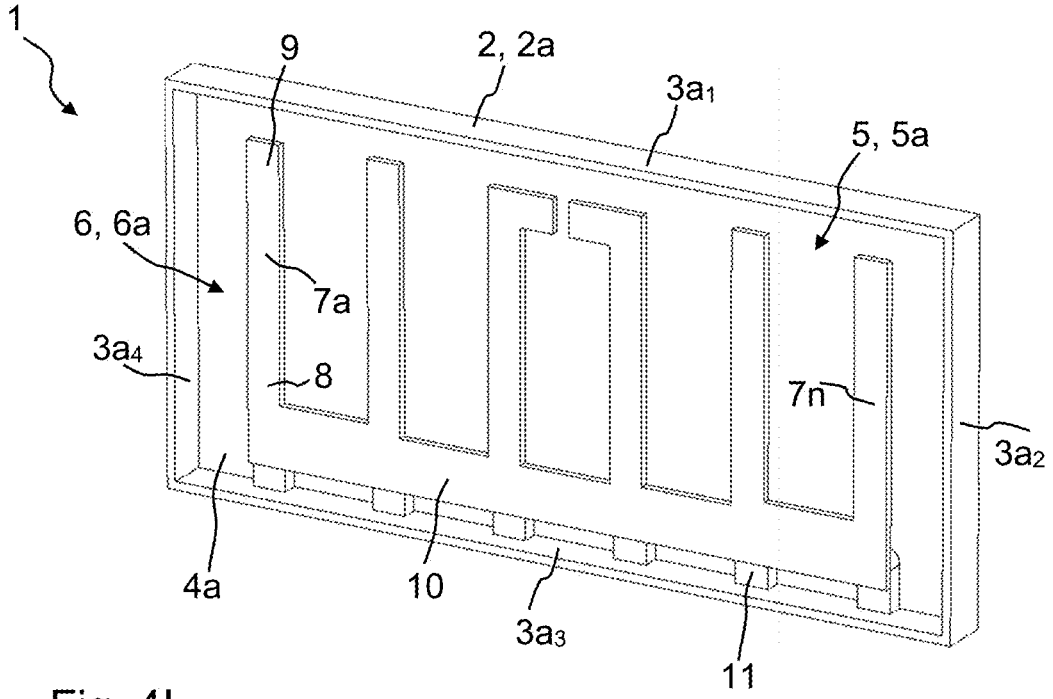

The structure of the resonator inner conductor arrangement 6, 6*a* in FIG. 4H essentially corresponds to that of FIG. 2. The resonator inner conductor arrangement 6, 6*a* rests on the second end 9 of its resonator inner conductors 7*a* to 7*n* on the pedestal arrangement 11. Here, the common connecting bridge 10 does not run through a straight line but is divided into connecting bridge sections 10*a* to 10*n* that lie offset to one another.

Figure 4J:
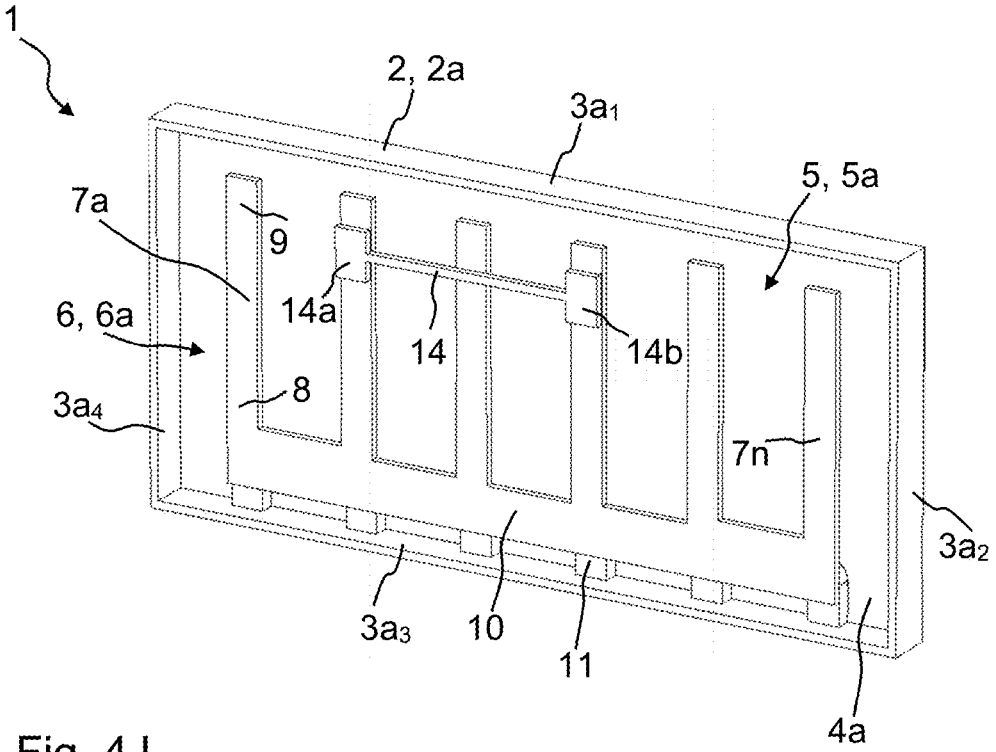

FIG. 4J shows an overcoupling between two resonator inner conductors 7*a* to 7*n* that are not adjacent. In this case, a capacitive overcoupling is shown. The capacitive overcoupling is formed by an overcoupling element 14 that has at least two galvanically connected capacitive coupling surfaces 14*a*, 14*b*. Each of these capacitive coupling surfaces 14*a* 14*b* runs preferably parallel or with one component predominantly parallel to the corresponding resonator inner conductor 7*a* to 7*n*. The coupling surfaces 14*a*, 14*b* are arranged preferably closer to the second end 9 of the corresponding resonator inner conductor 7*a* to 7*n* than to the first end 8. The capacitive coupling surfaces 14*a*, 14*b* are arranged between the resonator inner conductor 7*a* to 7*n* and the corresponding front wall 4*a*, 4*b* or the lid arrangement 2*c*. The overcoupling element 14 is galvanically separated from the resonator inner conductors 7*a* to 7*n* and the housing 2. Between the capacitive coupling surfaces 14*a*, 14*b* and the resonator inner conductors 7*a* to 7*n*, it is also possible to arrange a dielectric material, on which the capacitive coupling surfaces 14*a*, 14*b* rest.

An inductive overcoupling would also be possible, wherein it would be formed by an overcoupling rod (not depicted). Said overcoupling rod would be galvanically connected, for example, soldered, to two resonator inner conductors 7*a* to 7*n* that are not adjacent. The arrangement would be similar to that of the overcoupling element 14.

Two adjacent resonator inner conductors 7*a* to 7*n* could also be inductively coupled in that the connecting bridge 10 between those two resonator inner conductors 7*a* to 7*n* is wider than between two other resonator inner conductors 7*a* to 7*n*.

In general, a coupling between two adjacent resonator inner conductors 7*a* to 7*n* exists both over their line of sight and the corresponding part of the connecting bridge 10. The coupling can also be varied, for example, by changing the distances of the adjacent resonator inner conductors 7*a* to 7*n*, or by varying the position (closer toward the bottom or closer toward the open end), or by varying the shape (e.g. thinner or thicker) of the corresponding connecting bridge section 10*a* to 10*n*.

Figure 6:
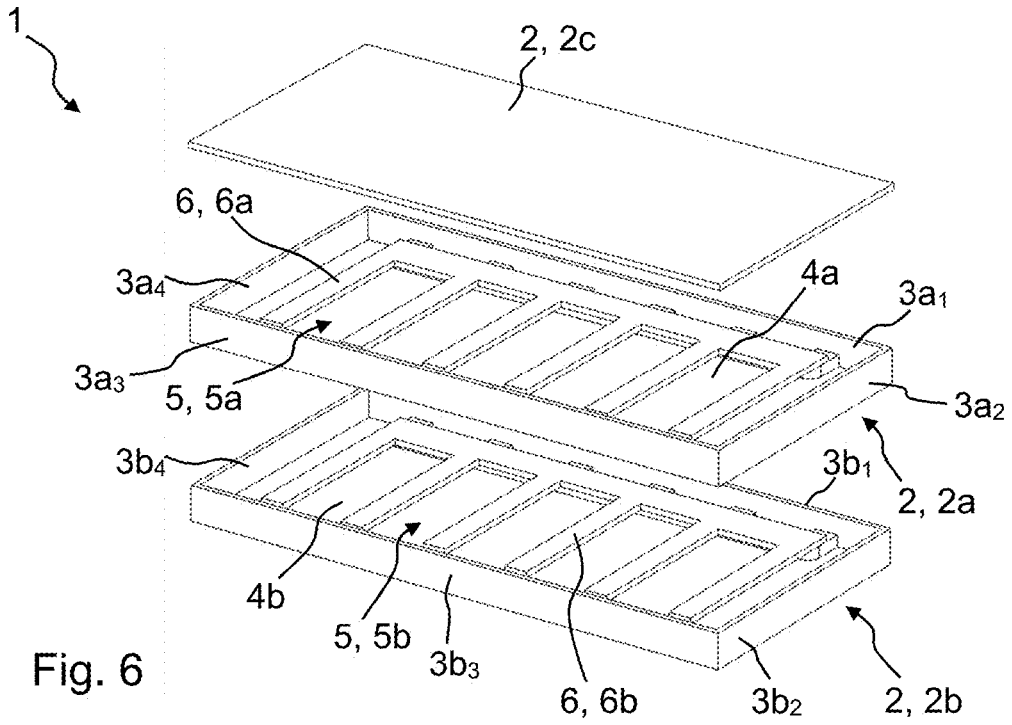
FIG. 6: the application of a plurality of resonator inner conductor arrangements arranged on top of one another.

FIG. 6 shows a further embodiment of the coaxial filter 1. In addition to the trough-shaped housing element 2*a*, the receiving space 5 of which is enclosed by the front wall 4*a* and the sidewalls $3a_1$ to $3a_4$ and the lid arrangement 2*c*, the coaxial filter 1 also comprises an additional trough-shaped housing element 2*b*. This additional trough-shaped housing element 2*b* is designed similar to the already described trough-shaped housing element 2*a*. The space 5*b*, which is delimited by the sidewalls $3b_1$ to $3b_4$, is additionally delimited by the front wall 4*b* and the front wall 4*a* of the trough-shaped housing element 2*a* positioned above. One resonator inner conductor arrangement 6, 6*a*, 6*b* is arranged in each of the two spaces 5*a*, 5*b*. The front wall 4*a* of the trough-shaped housing element 2*a*, which separates the two spaces 5*a*, 5*b*, preferably comprises a coupling opening 15 (see FIG. 8P), through which the individual resonator inner conductor arrangements 6, 6*a*, 6*b* are partially coupled with one another.

Figure 7A:
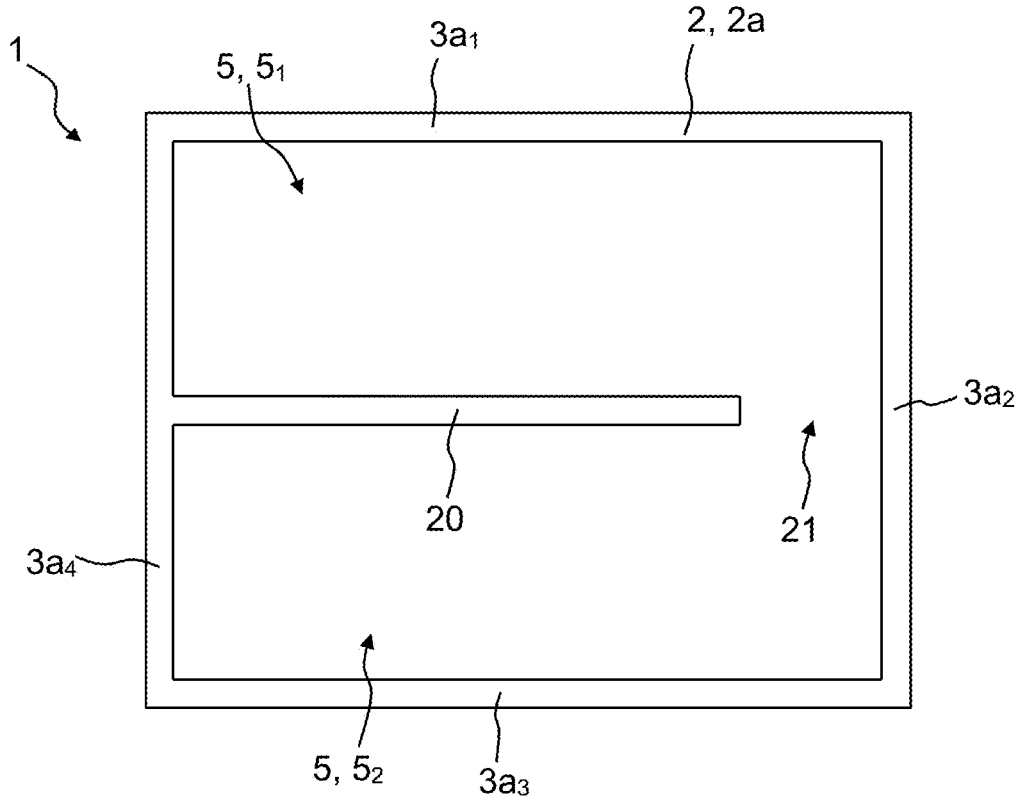
FIGS. 7A, 7B: the application of a separator that divides the receiving space into two receiving chambers.
Figure 7B:
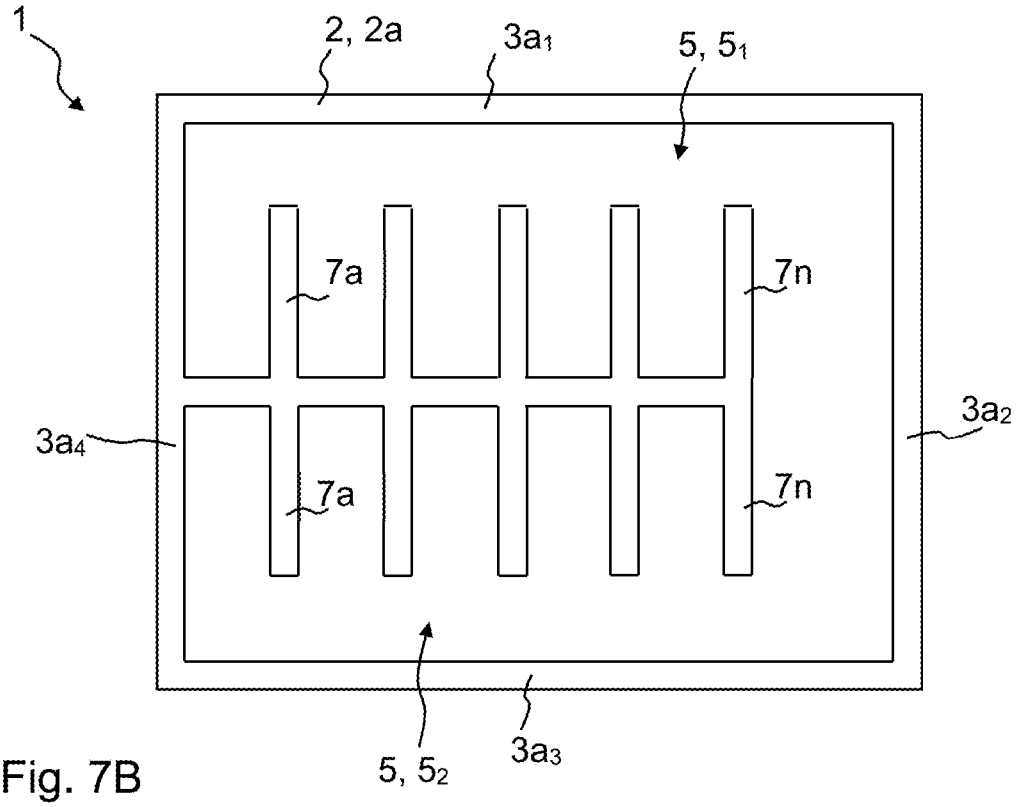

FIGS. 7A and 7B show a further embodiment of the coaxial filter 1. In the event that two trough-shaped housing elements 2*a*, 2*b* are used, which jointly surround the receiving space 5, one electrically conducting separator 20 each runs from a sidewall 3*a*1 to 3*a*4 or 3*b*1 to 3*b*4 in the direction of an opposite side wall 3*a*1 to 3*a*4 or 3*b*1 to 3*b*4 and ends there by forming an opening 21 with said side wall 3*a*1 to 3*a*4 or 3*b*1 to 3*b*4, thus dividing the receiving space 5 into at least one first receiving chamber $5_1$ and a second receiving chamber $5_2$ and the opening 21 which connects the at least two receiving chambers $5_1$, $5_2$. The separator 20 is preferably integral with the corresponding trough-shaped housing element 2*a*, 2*b* and also electrically conducting. The individual receiving chambers $5_1$, $5_2$ are directly connected to or coupled with one another via the opening 21 without the interposition of a further chamber. The opening 21 is preferably free of parts of the resonator inner conductor arrangement 6, 6*a*, 6*b*, such as the resonator inner conductors 7*a* to 7*n*. The opening 21 preferably extends over the entire height of the receiving space 5 or preferably at least to the corresponding front wall 4*a*, 4*b*.

In the event that only one trough-shaped housing element 2*a* is used, which is closed off by the lid arrangement 2*c* and surrounds the receiving space 5, it has a separator 20 that runs from one sidewall 3*a*1 to 3*a*4 in the direction of the opposite sidewall 3*a*1 to 3*a*4, where it ends at a distance from said sidewall 3*a*1 to 3*a*4, while forming an opening 21. The separator 20 is once again electrically conducting, and preferably integral with the sidewall 3*a*1 to 3*a*4.

The common connecting bridge 10 preferably rests on the separator 20. The individual resonator inner conductors 7*a* to 7*n* of the at least one resonator inner conductor arrangement 10 thus extend into the first and the second receiving chamber $5_1$, $5_2$ of the receiving space 5.

When two trough-shaped housing elements 2*a*, 2*b* are used, the common connecting bridge 10 is preferably arranged between the two separators 20 and further preferably crimped and/or screwed and/or soldered to them. FIG. 7A shows a longitudinal section through a trough-shaped housing element 2*a*, 2*b*, while FIG. 7B shows a top view of a trough-shaped housing element 2*a* or 2*b* with the resonator inner conductor arrangement 6, 6*a* placed onto its separator. The individual resonator inner conductors 7*a* to 7*n* proceed from the common connecting bridge 10 and extend away from it in two different directions and end in the first and in the second receiving chamber $5_1$, $5_2$ of the receiving space 5.

In the event that only one trough-shaped housing element 2*a* is used, the common connecting bridge 10 is preferably arranged between the separator 20 and the lid arrangement 2*c*, and further preferably crimped and/or soldered and/or screwed to them. The first end 8 of the corresponding resonator inner conductors 7*a* to 7*n* comprises, for example, a segment that is curved in the direction of the front wall 4*a*, and so the resonator inner conductors 7*a* to 7*n* run over the predominant part of their length at a predefined distance from the lid arrangement 2*c*. The distance to the lid arrangement 2*c* is preferably more than 10% or 20% or 30% or 40% of the distance between the front side 4*a* and the lid arrangement 2*c*.

In FIGS. 8A to 8L, the attachment of the resonator inner conductor arrangement 6, 6*a* in the housing 2 is explained in more detail.

Figure 8A:
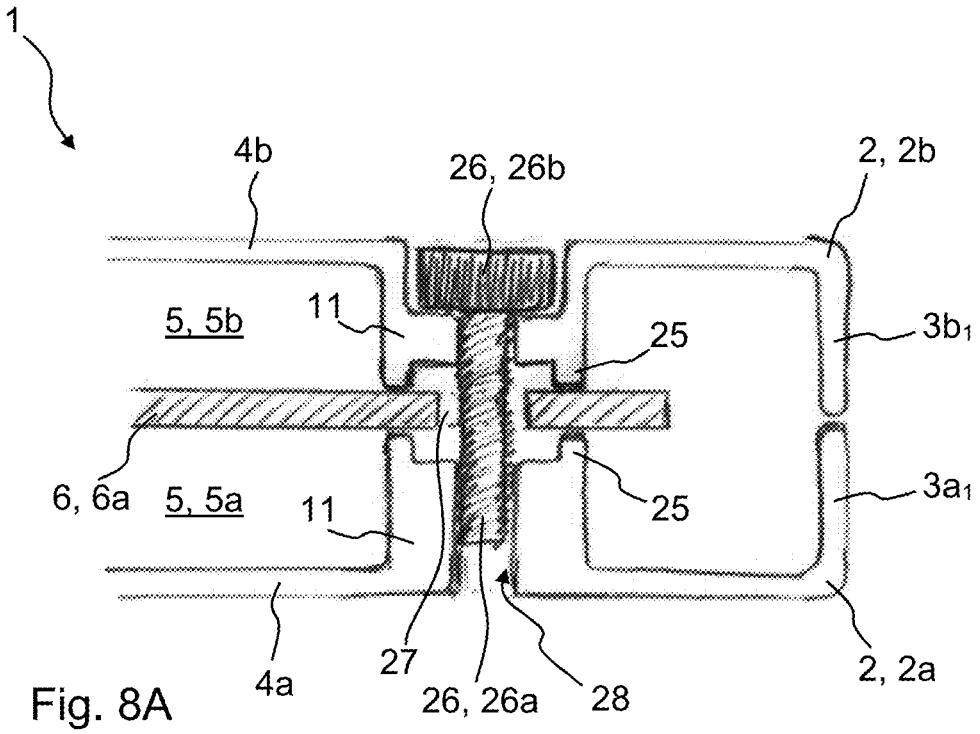
FIGS. 8A to 8L: different fastening options for the resonator inner conductor arrangement.

FIG. 8A shows that the resonator inner conductor arrangement 6, 6*a* is connected galvanically to the housing 2. FIG. 8A shows a housing 2 consisting of two trough-shaped housing elements 2*a*, 2*b*, the sidewalls 3*a*1 to 3*a*4 or 3*b*1 to 3*b*4 of which are placed on top of one another and surrounded by the corresponding front walls 4*a*, 4*b*. In addition, a gap (right part) is shown between the two trough-shaped housing elements 2*a*, 2*b*. However, said gap serves mainly for illustration purposes in order to highlight that these two trough-shaped housing elements 4*a*, 4*b* are not integral with one another. The resonator inner conductor arrangement 6, 6*a* runs centrally through the receiving space 5. This means that it is essentially spaced apart from the two front walls 4*a*, 4*b* at an equal distance. The term "approximately" means that a difference of less than 10% or less than 5% is preferably deemed to be included. A course outside from the center would also be conceivable.

In FIG. 8A, the at least one resonator inner conductor arrangement 6, 6*a* is clamped and/or screwed between the two trough-shaped housing elements 2*a*, 2*b*. More precisely, a pedestal arrangement 11 extends from each trough-shaped housing element 2*a*, 2*b* into the receiving space 5. The resonator inner conductor arrangement 6, 6*a* is arranged between the two pedestal arrangements 11. For that purpose, the pedestal arrangements 11 have corresponding support shoulders 25, on which the resonator inner conductor arrangement 6, 6*a*, rests, particularly with its common connecting bridge 10. The resonator inner conductor arrangement 6, 6*a* is preferably only in contact with the pedestal arrangements 11. The resonator inner conductor arrangement 6, 6*a* is preferably not arranged or clamped between sidewalls $3a_1$, $3a_2$, $3a_3$, $3a_4$, $3b_1$, $3b_2$, $3b_3$, $3b_4$ of the trough-shaped housing elements 2*a*, 2*b*. The resonator inner conductor arrangement 6, 6*a* is preferably exclusively arranged within the receiving space 5 and spaced apart from the sidewalls $3a_1$, $3a_2$, $3a_3$, $3a_4$, $3b_1$, $3b_2$, $3b_3$, $3b_4$ of the trough-shaped housing elements 2*a*, 2*b*.

The pedestal arrangement 11 is at least partially penetrated by a fastening opening 28 and preferably has a thread. A screw 26 with a screw body 26*a* and a screw head 26*b* engages in the two pedestal arrangements 11. By tightening the screw connection, the two pedestal arrangements 11, i.e. both trough-shaped housing elements 2*a*, 2*b*, are pressed toward one another. For that purpose, only the pedestal arrangement 11 of the two pedestal arrangements 11, which is spaced further apart from the screw head 26*b*, is provided with a thread. The screw body 26*a* also penetrates the resonator inner conductor arrangement 6, 6*a* which is preferably designed to be exclusively thread-free. In the depicted example, the opening 27 in the resonator inner conductor arrangement 6, 6*a* is greater than the diameter of the screw body 26*a*.

The screw head 26*b* is arranged outside of the housing 2. In the depicted embodiment, the housing 2, particularly the further trough-shaped housing element 2*b*, comprises a recess, in which the screw head 26*b* is arranged, and so it does not protrude over the remaining front wall 4*b* of the housing element 2*b*. Therefore, the screw head 26*b* is recessed in a receiving space, which is accessible from the outside, in one of the two housing elements 2*a*, 2*b*.

In the embodiment, the openings, particularly the fastening openings 28, penetrate both pedestal arrangements 11 completely. The pedestal arrangements 11 are preferably individually integral with the corresponding front walls 4*a*, 4*b* and spaced apart from the sidewalls $3a_1$, $3a_2$, $3a_3$, $3a_4$, $3b_1$, $3b_2$, $3b_3$, $3b_4$ of the trough-shaped housing elements 2*a*, 2*b*. The pedestal arrangements 11 touch (contact) preferably directly the resonator inner conductor arrangement 6, 6*a* without an additional dielectric material being arranged in between.

Figure 8B:
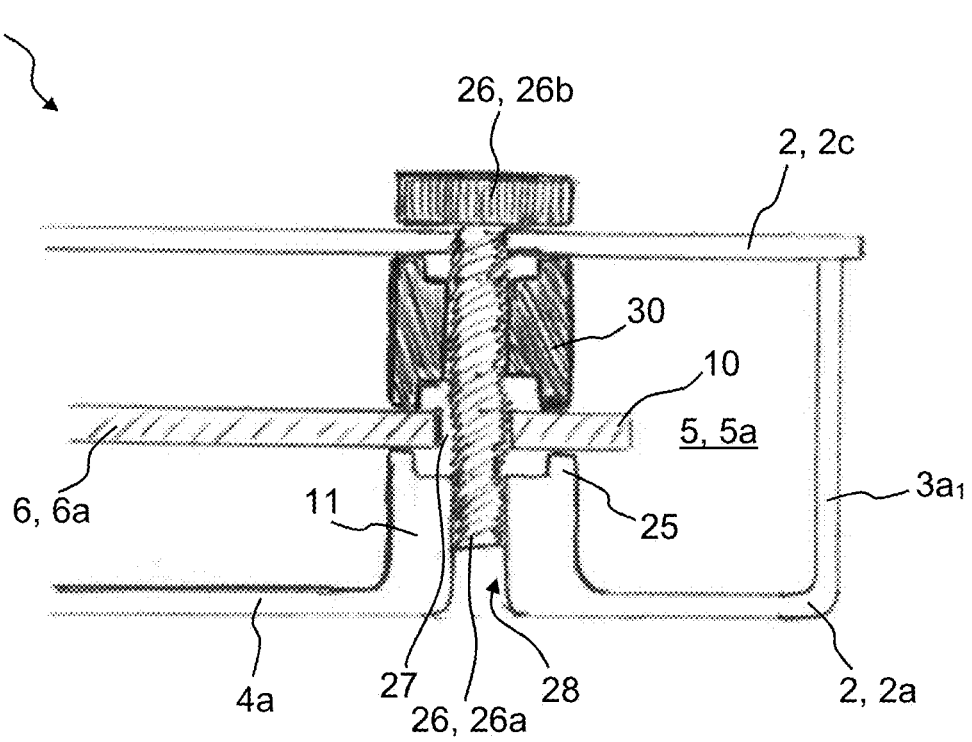

FIG. 8B shows a cross-section of a housing 2 which consists of a trough-shaped housing element 2*a* and a lid arrangement 2*c*. The resonator inner conductor arrangement 6, 6*a* once again rests on a pedestal arrangement 11. The pedestal arrangement 11 extends from the front side 4*a* of the trough-shaped housing element 2*a* into the receiving space 5. The pedestal arrangement 11 is once again completely penetrated by a fastening opening 28 that has a thread.

A spacer 30 is also arranged between the resonator inner conductor arrangement 6, 6*a* and the housing lid 2*c*. The at least one resonator inner conductor arrangement 6, 6*a* is thus clamped between the pedestal arrangement 11 and the at least one spacer 30. The spacer 30 can consist of a dielectric material or an electrically conducting material. The fastening opening 28, in which the screw connection 26 at least partially engages, extends through the resonator inner conductor arrangement 6, 6*a* and the at least one spacer 30 and the lid arrangement 2*c*. The screw body enters from the outside of the housing 2 through the fastening opening 28 into the lid arrangement 2*c* and penetrates the spacer 30 and the resonator inner conductor arrangement 6, 6*a* completely and the pedestal arrangement 11 at least to some extent. The screw head 26*b* is arranged outside of the housing 2 on an outer side of the lid arrangement 2*c*.

Figure 8C:
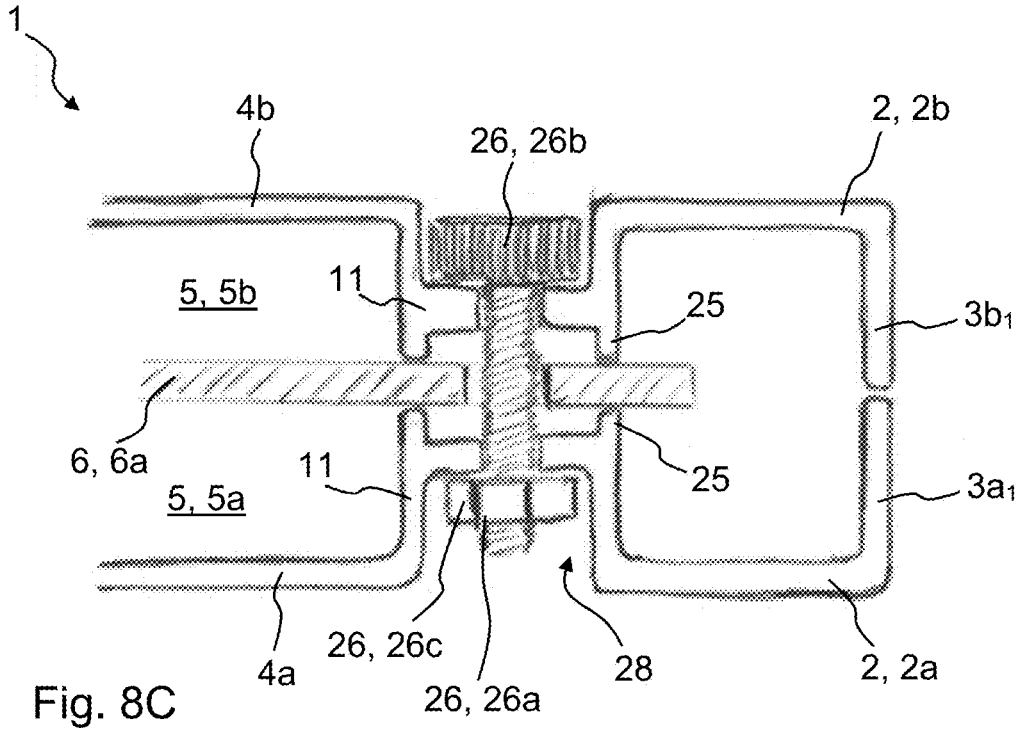

FIG. 8C shows an embodiment similar to the one from FIG. 8A. In this case, both pedestal arrangements 11 comprise a receiving space which is at least to some extent accessible from the outside. In the one receiving space, the screw head 26*b* is arranged. In the other receiving space, a nut 26c is arranged which is in mesh with the screw body 26*a*. In this embodiment, the fastening openings 28 are designed to be threadless.

Figure 8D:
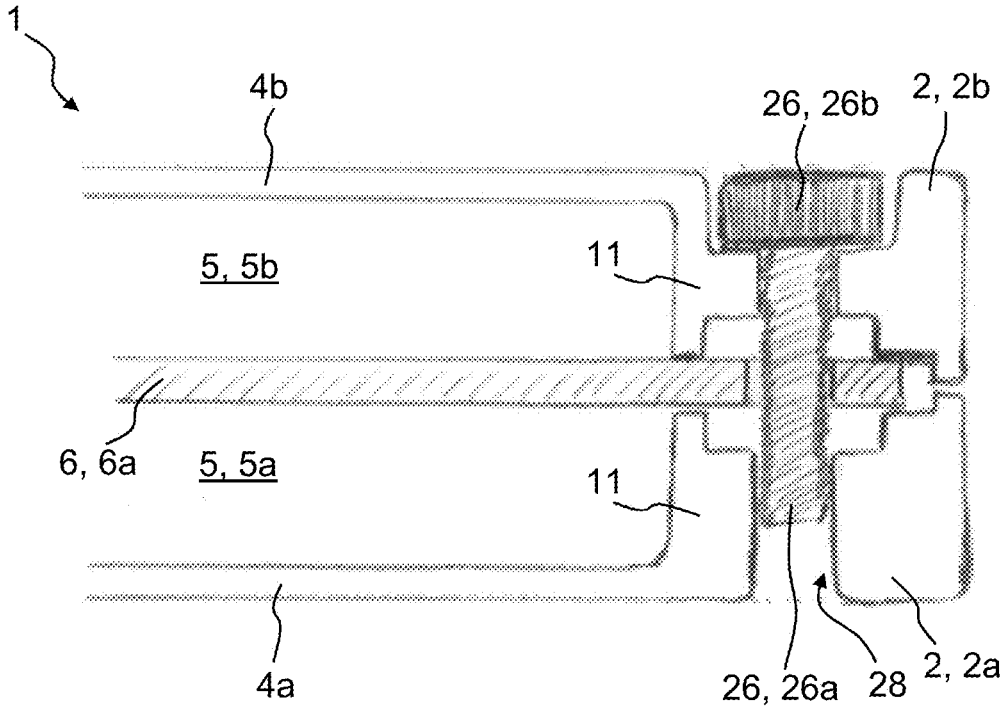

FIG. 8D corresponds to the embodiment from 8A. The screw connections penetrates one side wall $3a_1$ to $3a_4$ or $3b_1$ to $3b_4$ of one trough-shaped housing element 2*a*, 2*b* each. Depending on the point of view, it can also be said that the pedestal arrangement 11 in each trough-shaped housing element 2*a*, 2*b* is located both on the corresponding front side 4*a*, 4*b* and the corresponding sidewall 3*a*1 to 3*a*4 or 3*b*1 to 3*b*4.

Figure 8E:
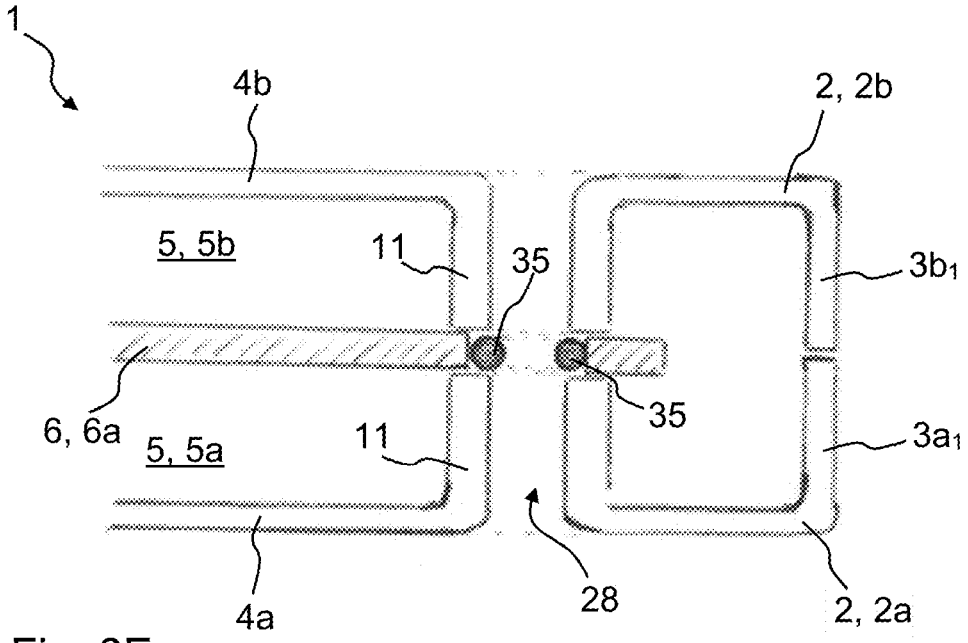

In FIG. 8E, the cross-section of the coaxial filter 1 shows that the resonator inner conductor arrangement 6, 6*a* is soldered to the housing 2, particularly to the two trough-shaped housing elements 2*a*, 2*b*, and there particularly to the corresponding pedestal arrangement 11 which extend toward one another. The structure corresponds approximately to that from FIG. 8A, where a screw connection was foregone. The pedestal arrangements 11 run from the front walls 4*a*, 4*b* into the receiving space 5. The pedestal arrangements 11 are once again penetrated by the fastening opening 28. This fastening opening 28 also penetrates the resonator inner conductor arrangement 6, 6*a*. The pedestal arrangements 11 each comprise a front side, wherein the two front sides of the pedestal arrangements 11 face one another. The resonator inner conductor arrangement 6, 6*a* rests on said front sides or is clamped between said front sides. A solder connection 35 is formed on the inner wall, which is formed by the fastening opening 28 in the resonator inner conductor arrangement 6, 6*a*, and the corresponding front sides of the pedestal arrangements 11. This solder deposit 35 is accessible via the fastening openings 28 in the pedestal arrangements 11.

Figure 8F:
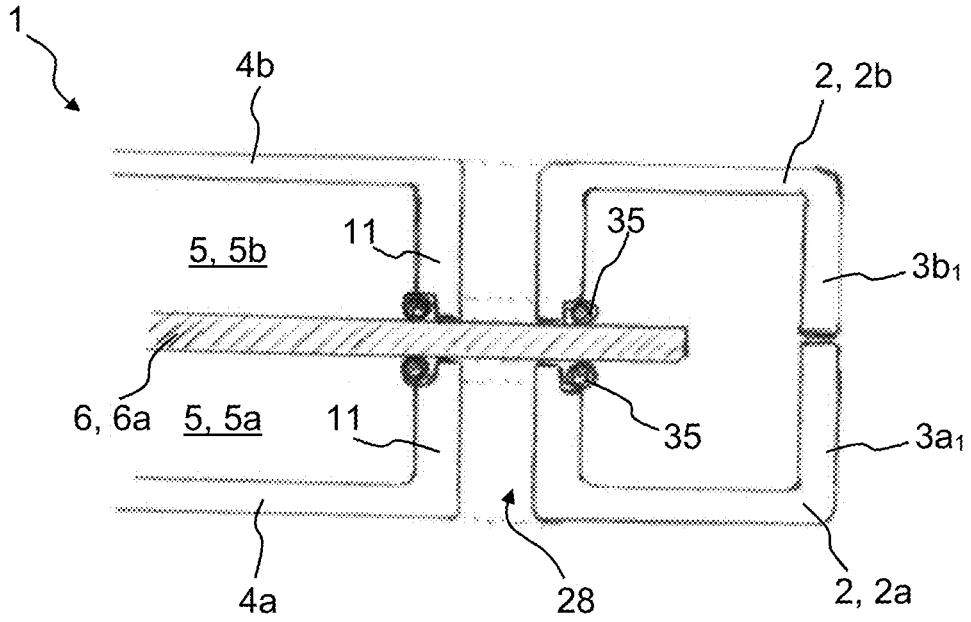

FIG. 8F shows a similar embodiment as 8E. In this case, the resonator inner conductor arrangement 6, 6*a* is not penetrated by the fastening opening 28. A solder connection 35 takes place between the upper side and the underside of the resonator inner conductor arrangement 6, 6*a*, particularly of the common connecting bridge 10 and the corresponding pedestal arrangements 11 of the two trough-shaped housing element 2*a*, 2*b*. The solder connections 35 are not accessible through the fastening openings 28 but only through the corresponding receiving space 5. The solder connections 35, for example, can be produced from a previously inserted solder molded part. This applies to all solder connections 35. For example, the solder connections 35 can be melted by inductive soldering or by heating in a reflow oven. These solder connections 35 rest on a stepped recess in the corresponding pedestal arrangements 11.

Figure 8G:
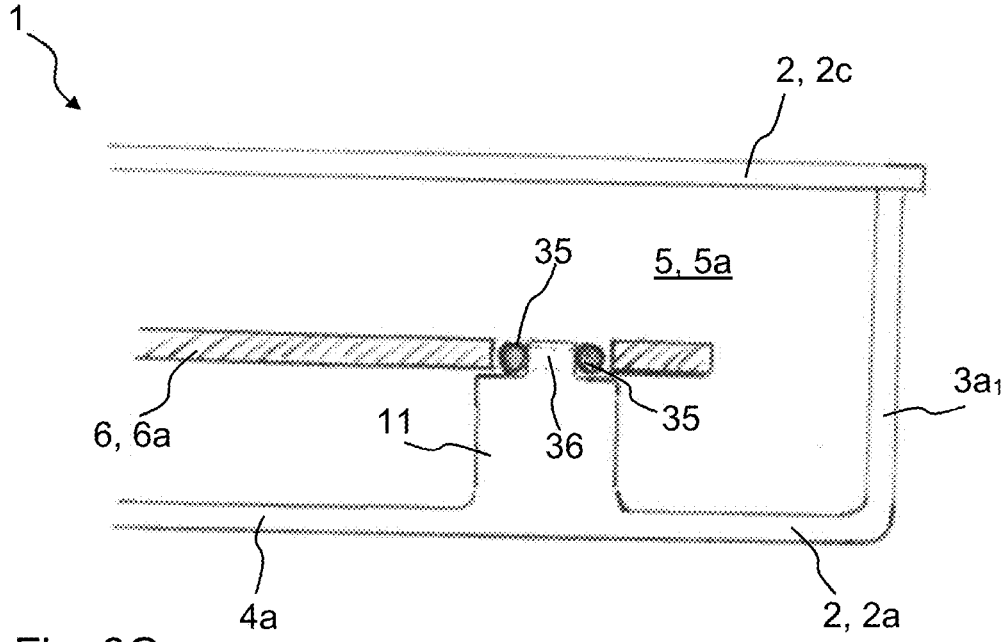

FIG. 8G shows a further embodiment of the coaxial filter 1. The resonator inner conductor arrangement 6, 6*a* rests on a pedestal arrangement 11 which extends from a front wall 4*a*, 4*b* into the receiving space 5. The pedestal arrangement 11 has a protrusion 36 which penetrates an opening of the resonator inner conductor arrangement 6, 6*a* and is surrounded by support shoulders, on which, in addition to a solder deposit 35, a part of the resonator inner conductor arrangement 6, 6*a*, particularly a part of the common connecting bridge 10, is arranged.

Figure 8H:
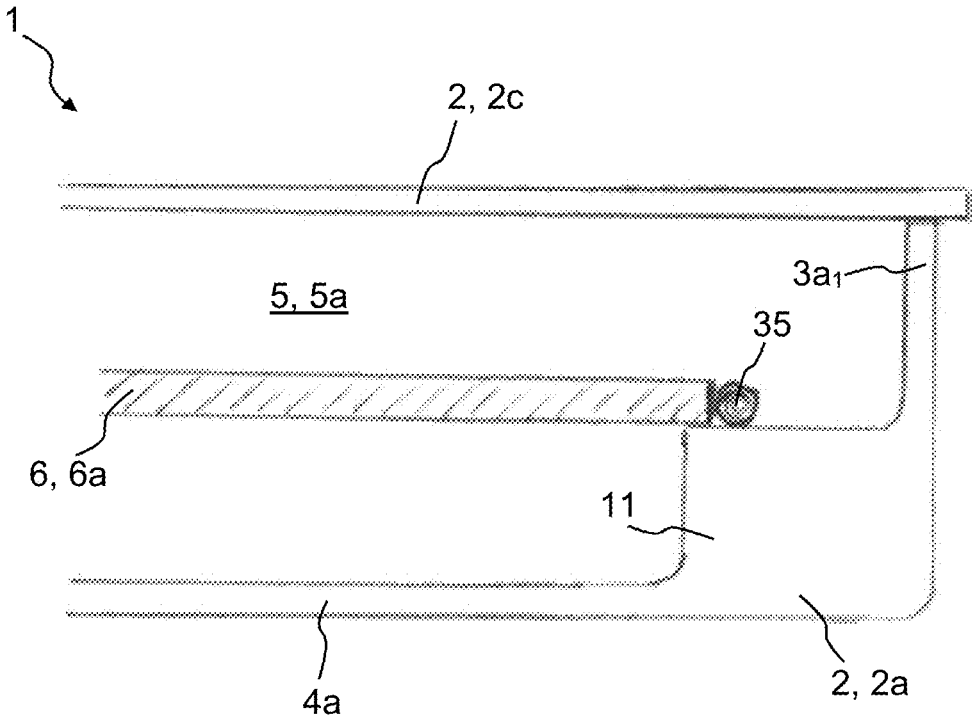

FIG. 8H shows a similar embodiment as FIG. 8G. However, the pedestal arrangement 11 is formed on both the front wall 4*a* and on one or more of the sidewalls 3*a*1 to 3*a*4 and extends into the receiving space 5. Instead of a second trough-shaped housing element 2*b*, a lid arrangement 2*c* is provided. The resonator inner conductor arrangement 6, 6*a* rests on the pedestal arrangement 11. The same also applies to a solder deposit 35, by means of which the resonator inner conductor arrangement 6, 6*a* can be soldered to the pedestal arrangement 11.

As was described with reference to the embodiments of FIGS. 3A to 3D, the pedestal arrangement 11 is a multiplicity of unconnected individual pedestals or a continuous pedestal.

Figure 8I:
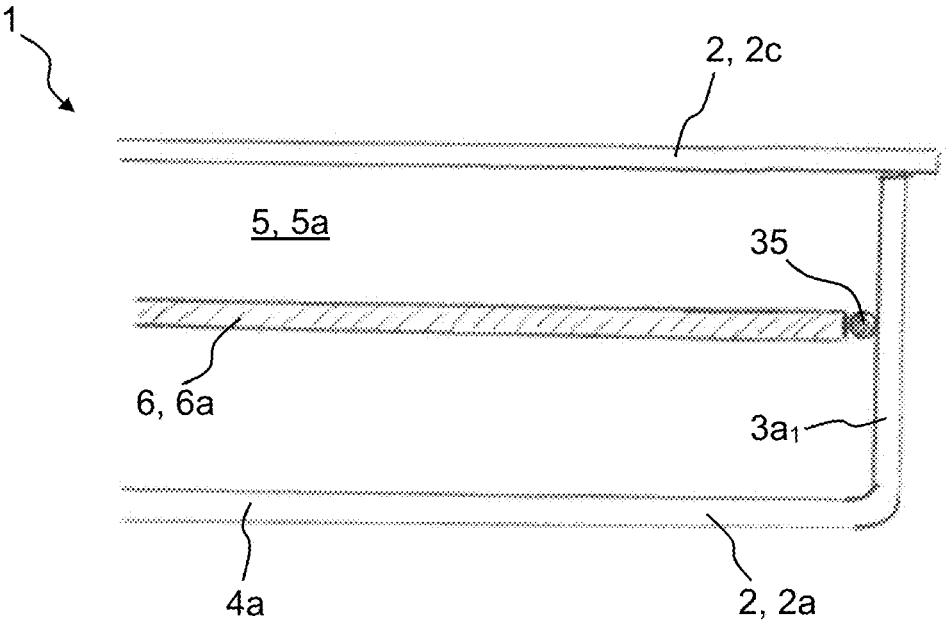

FIG. 8I shows that the resonator inner conductor arrangement 6, 6*a* is soldered to one or more sidewalls $3a_1$ to 3*a*4 of the trough-shaped housing element 2*a*. The distance of the resonator inner conductor arrangement 6, 6*a* to the front wall 4*a* is approximately the same as the distance between the resonator inner conductor arrangement 6, 6*a* and the lid arrangement 2*c*. The term "approximately" means that a difference between two distances is preferably less than 10%, further preferably less than 5%.

Figure 8J:
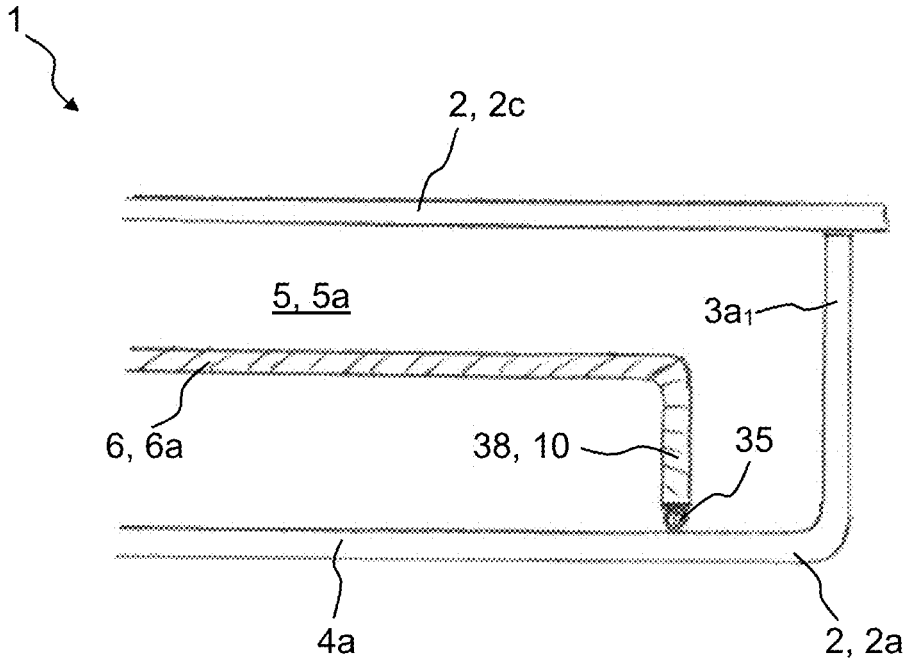

FIG. 8J describes in a further embodiment as to how the resonator inner conductor arrangement 6, 6*a* can be soldered to the housing 2. The resonator inner conductor arrangement 6, 6*a* has a segment 38 which is curved at least with regard to the predominant part of the resonator inner conductors 7*a* to 7*n* in the direction of the front side 4*a* of the at least one trough-shaped housing element 2*a* and soldered to said front side 4*a*. Preferably, this segment 38 is the common connecting bridge 10.

Figure 8K:
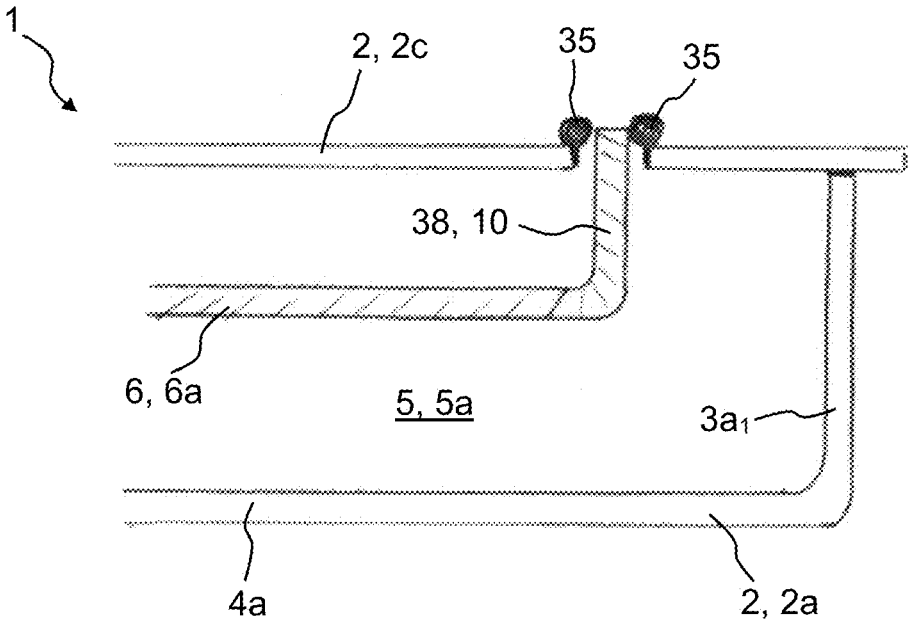

With reference to FIG. 8K, said segment 38 does not run in the direction of the front side 4*a* but in the direction of the lid arrangement 2*c*. Preferably, the lid arrangement 2*c* has an opening, through which a part of the resonator inner conductor arrangement 6, 6*a* protrudes and is soldered to the lid arrangement 2*c* outside of the housing 2.

Figure 8L:
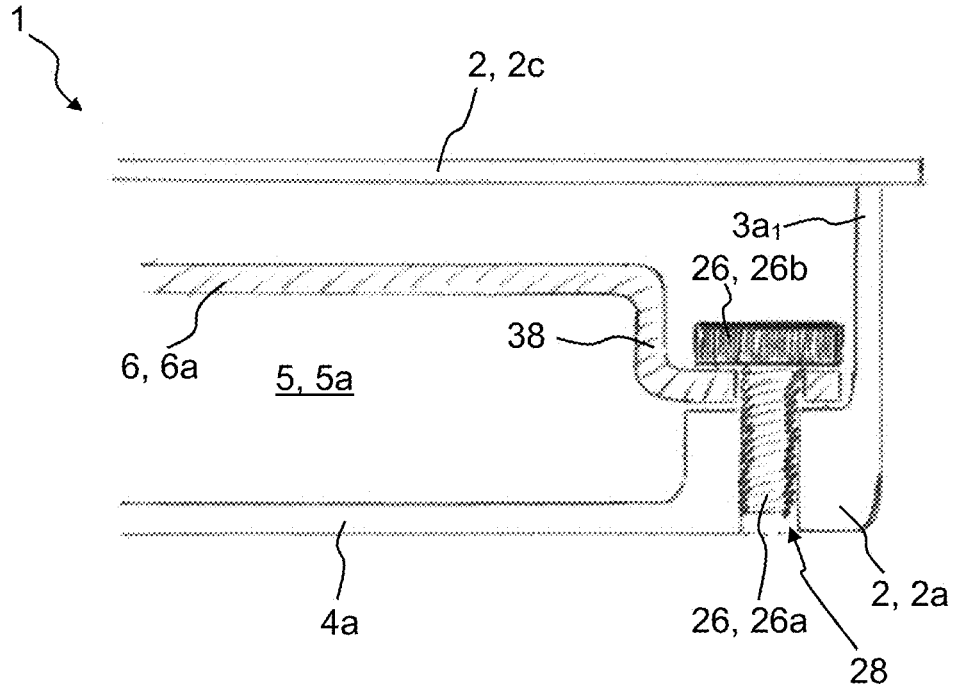

FIG. 8L shows a similar embodiment as FIG. 8H. Instead of the resonator inner conductor arrangement 6, 6*a* being soldered to the pedestal arrangement 11, it is screwed to the pedestal arrangement 11. The screw head 26*b* is located in the receiving space 5. One part of the resonator inner conductor arrangement 6, 6*a* rests on the pedestal arrangement 11 and, together with the pedestal arrangement 11, is penetrated by the fastening opening 28. In this case, the fastening opening 28 comprises a thread, and so the screw body 26*a* can be screwed together with said thread. The resonator inner conductor arrangement 6, 6*a* once again comprises a segment 38 which is curved with regard to the individual resonator inner conductors 7*a* to 7*n* in the direction of the front wall 4*a*. The part of the resonator inner conductor arrangement 6, 6*a* that rests on the pedestal arrangement 11 thus runs parallel or with one component predominantly parallel to the individual resonator inner conductors 7*a* to 7*n* but is arranged closer to the front wall 4*a* than the individual resonator inner conductors 7*a* to 7*n*. Said part is preferably the common connecting bridge 10. However, it can also be the second end 9 of the individual resonator inner conductors 7*a* to 7*n*.

The screw 26 can be an electrically conducting screw or a screw 26 made of a dielectric material.

Figure 8M:
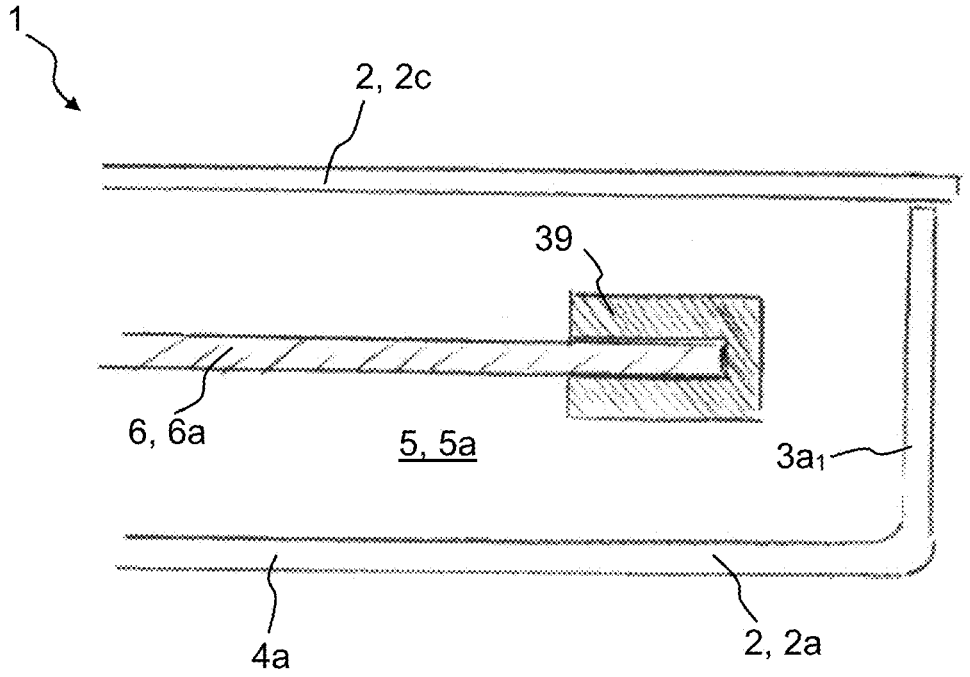
FIGS. 8M, 8N: different options for increasing the capacitive coupling between the housing and the resonator inner conductor arrangement.

FIG. 8M illustrates how the coupling between the resonator inner conductor arrangement 6, 6*a* and the housing 2 can be strengthened. In particular, a dielectric material 39 is applied, particularly placed or pushed onto, the second end 9 of at least one or all of the resonator inner conductors 7*a* to 7*n*, wherein said dielectric material 39 is preferably U-shaped and thus covers the second end 9 of the at least one resonator inner conductor 7*a* to 7*n* on both sides. A fastening mechanism, particularly in the form of a snap-in connection, would also be conceivable. It is also possible for the second end 9 to be completely enclosed by a dielectric material.

Figure 8N:
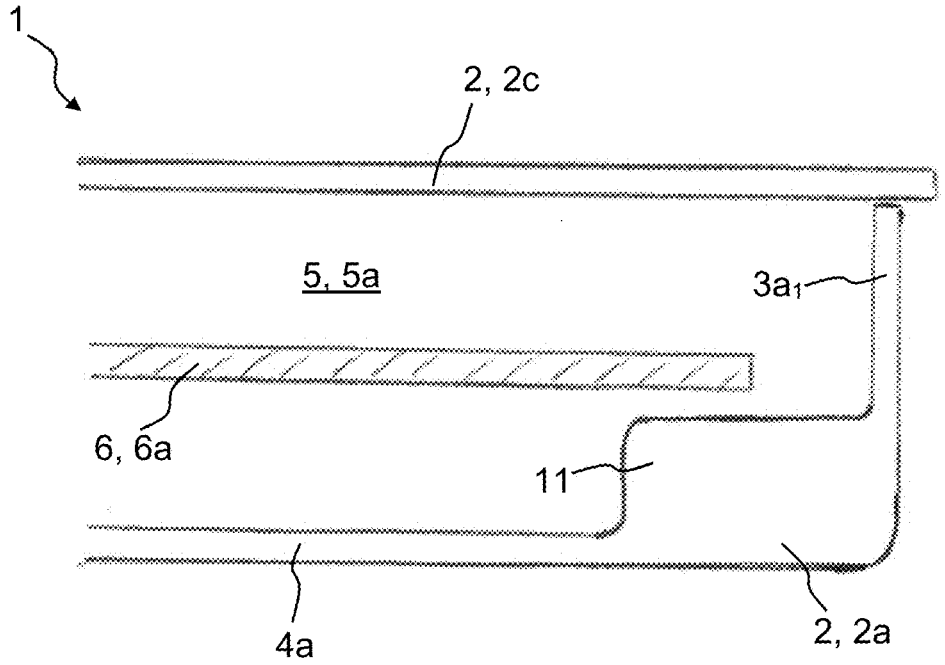

By contrast, FIG. 8N illustrates that a pedestal arrangement 11 extends in the direction of the resonator inner conductor arrangement 6, 6*a*, particularly in the direction of the second end 9 of at least one or all resonator inner conductors 7*a* to 7*n*, but ends by forming a clearance to said second end 9.

The embodiments of FIGS. 8M and 8N are used to influence the resonance frequencies. The greater capacitive load on the open end 9 of the at least one resonator inner conductor 7*a* to 7*n* decreases the resonance frequency. For that purpose, a longer resonator inner conductor 7*a* to 7*n* would be required which in turn would result in a larger design of the housing 2.

Figure 8O:
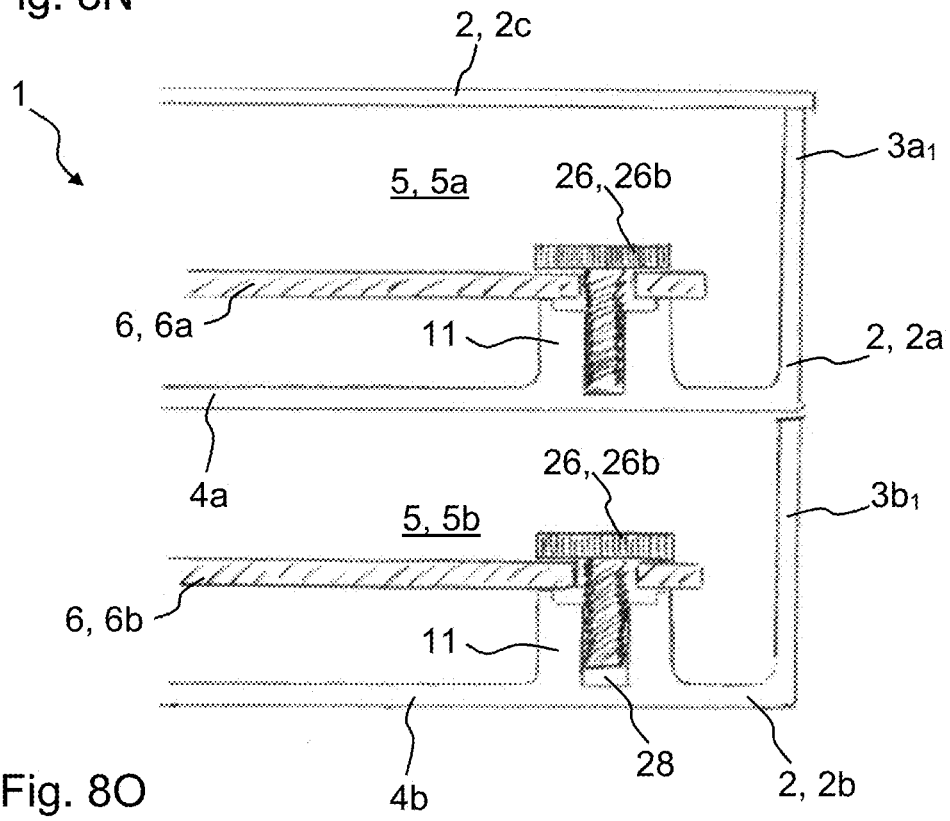
FIGS. 8O to 8S: different options as to how two resonator inner conductor arrangements can be arranged on top of one another and aligned.

FIG. 8O shows a cross-section of the coaxial filter 1, as it is shown in the exploded view from FIG. 6. A trough-shaped housing element 2*a* is closed off with the lid arrangement 2*c*. A pedestal arrangement 11 protrudes into the receiving space 5 thus formed. The pedestal arrangement 11 is to some extent penetrated by the fastening opening 28 which comprises a thread. By means of a screw, the resonator inner conductor arrangement 6, 6*a* rests on and is securely screwed to the pedestal arrangement 11 and thus clamped. The front wall 4*a* is once again used to close off a further trough-shaped housing element 2*b* which also contains a pedestal arrangement 11 which is only partially penetrated by the fastening opening 28 and contains a thread. The screw 26 is also used to screw together the further resonator inner conductor arrangement 6, 6*b* and the pedestal arrangement 11.

Figure 8P:
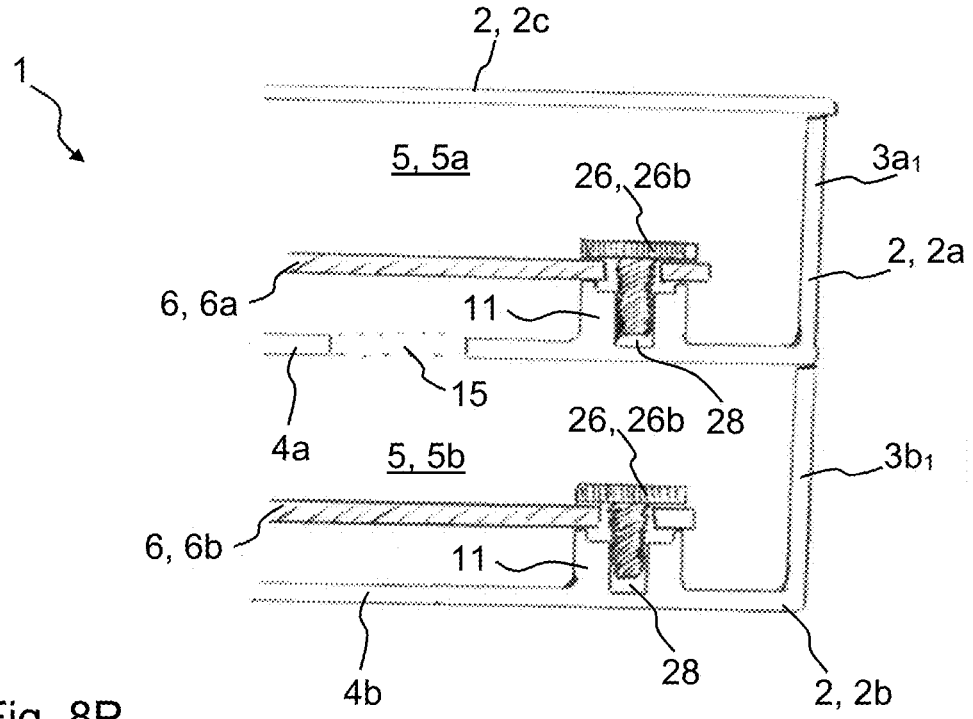

FIG. 8P shows a coupling opening 15 which is introduced in the front wall 4*a* of the trough-shaped housing element 2*a* and allows for a coupling between the der resonator inner conductor arrangement 6, 6*a* and the further resonator inner conductor arrangement 6, 6*b*.

It is also possible to insert a plurality of coupling openings 15 that can have different dimensions and shapes (e.g. square, rectangular, slotted, round, oval).

Figure 8Q:
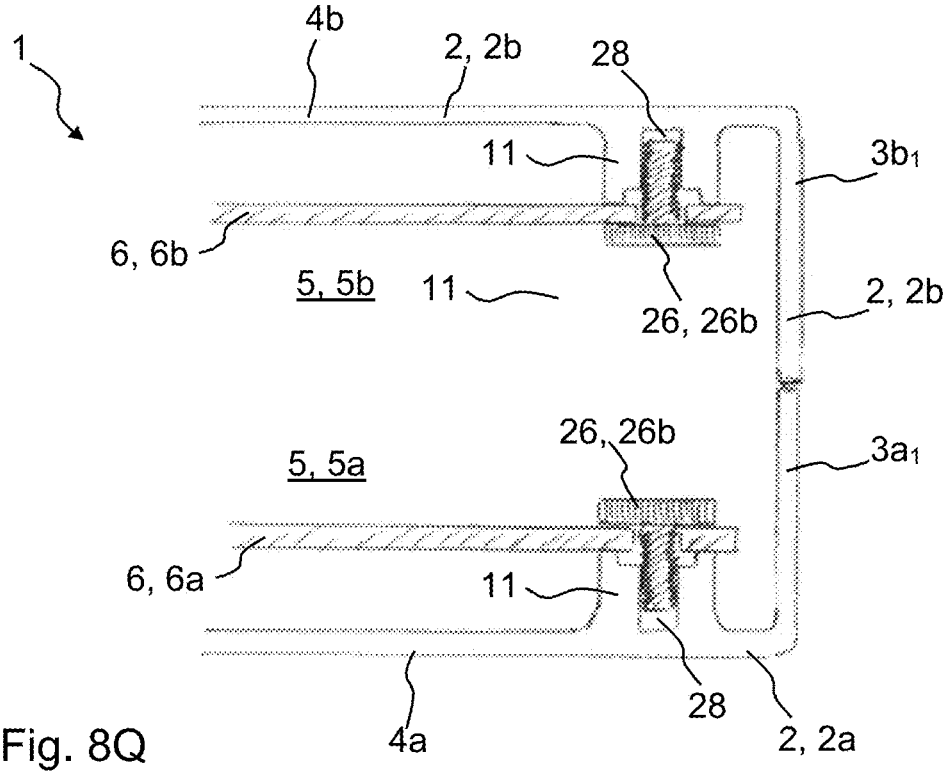
Figure 8R:
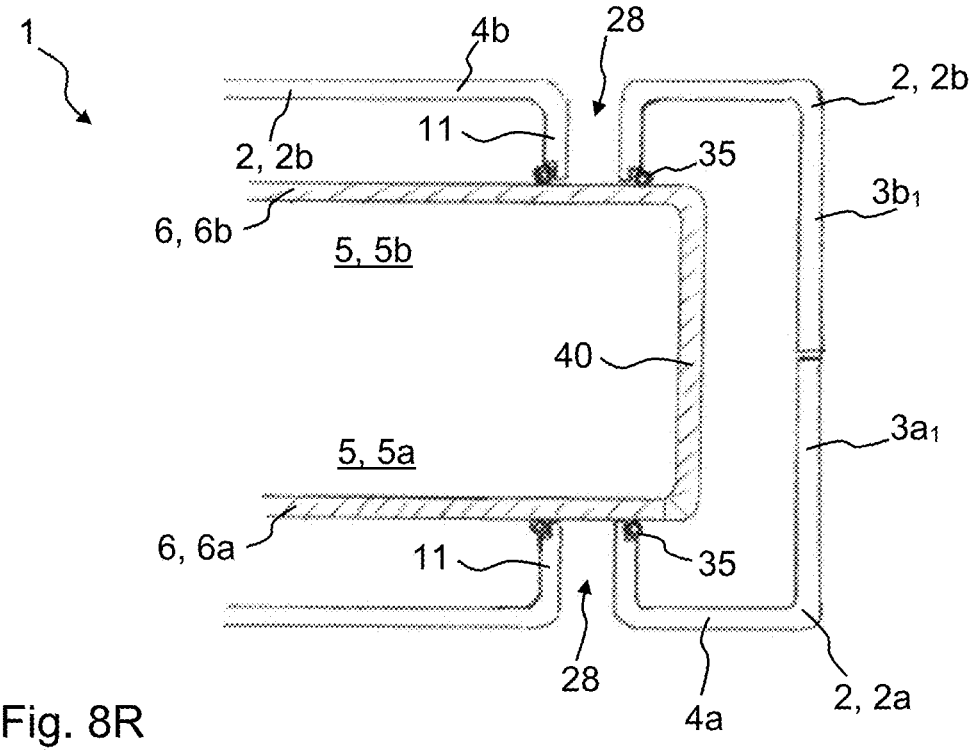
Figure 8S:
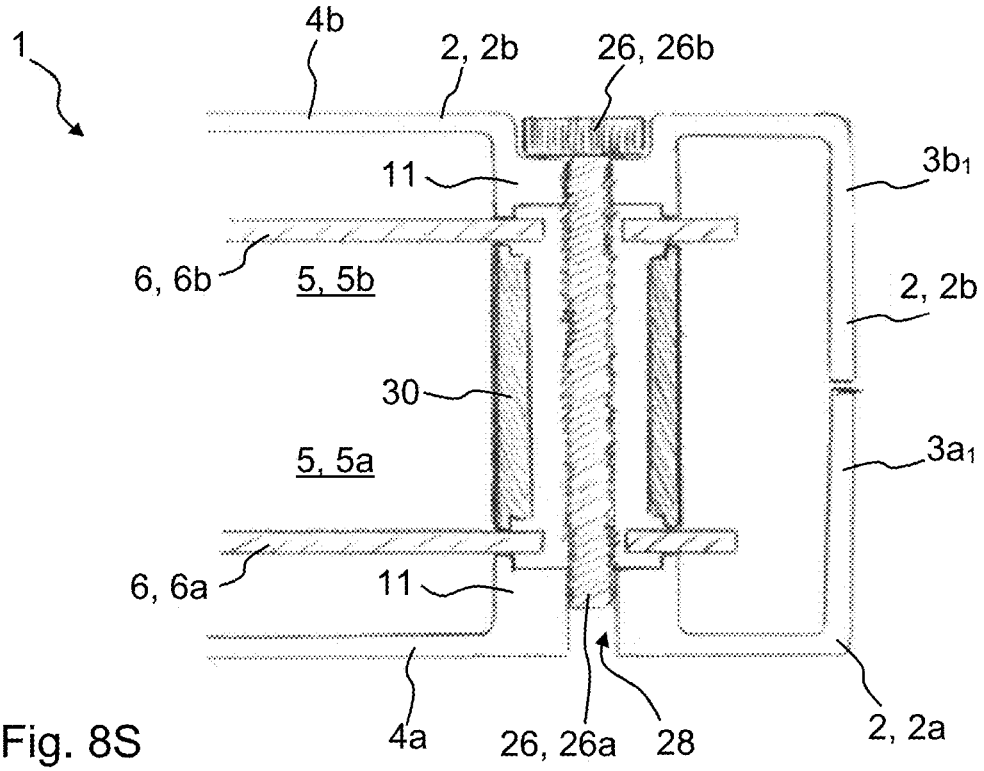

FIGS. 8Q, 8R, and 8S illustrate the use of at least two resonator inner conductor arrangements 6, 6*a*, 6*b* in a common receiving space 5 by using two trough-shaped housing elements 2*a*, 2*b*, the front walls 4*a*, 4*b* of which, together with the corresponding sidewalls 3*a*1 to 3*a*4 or 3*b*1 to 3*b*4, form the housing 2 of the coaxial filter 1. According to FIG. 8Q, in the thus surrounded common receiving space 5, two resonator inner conductor arrangements 6, 6*a*, 6*b* are arranged separately from one another. In this case, two pedestal arrangements 11 are formed which protrude from the corresponding front walls 4*a*, 4*b* into the receiving space 5. These pedestal arrangements 11 are only partially penetrated by the fastening opening 28 and have a thread, wherein the resonator inner conductor arrangements 6, 6*a*, 6*b* are screwed and/or clamped to the corresponding pedestal arrangement 11 by means of a screw. Soldering would also be possible, wherein the two trough-shaped housing elements 2*a*, 2*b* themselves would also be connected to one another by means of a screw or solder connection (not depicted).

FIG. 8R shows a one-piece resonator inner conductor arrangement 6, 6*a*, 6*b*. The separate resonator inner conductor arrangements 6, 6*a*, 6*b* shown in FIG. 8Q are additionally connected to one another by means of a curved connecting section 40 and designed as one-piece. The resonator inner conductor arrangements 6, 6*a*, 6*b* are soldered (particularly threadless) to the pedestal arrangement 11 which has an outwardly continuing fastening opening 28. The resonator inner conductor arrangement 6, 6*a*, 6*b*, designed with a U-shaped cross-section, can be designed to be elastic, and so the individual resonator inner conductors 7*a* to 7*n* of the individual resonator inner conductor arrangements 6, 6*a*, 6*b* want to move away from one another; as a result, the resonator inner conductor arrangement 6, 6*a*, 6*b* rests nicely on the pedestal arrangements 11.

FIG. 8S shows a further embodiment which is similar to that of FIG. 8Q. At least one, preferably both pedestal arrangements 11, which run toward one another, are completely penetrated by the fastening opening 28. A spacer 30, which braces the two resonator inner conductor arrangements 6, 6*a*, 6*b*, is located between the two separate resonator inner conductor arrangements 6, 6*a*, 6*b*. A screw connection completely penetrates at least one pedestal arrangement 11 and the spacer 30 as well as the two resonator inner conductor arrangements 6, 6*a*, 6*b* and preferably ends in the further pedestal arrangement 11. As a result, the resonator inner conductor arrangements 6, 6*a*, 6*b* can be securely screwed or clamped to the corresponding pedestal arrangement 11 by means of a screw connection 26.

In order to reduce the coupling, a separating element can additionally be inserted between the two resonator inner conductor arrangements 6, 6*a*, 6*b*.

It is further possible to screw adjusting elements in the form of adjusting screws from outside of the housing 2 at varying depths into the receiving space 5 in order to be able to adjust the coaxial filter 1.

In principle, separating plates that are preferably galvanically connected to the housing 2 can also be used. Such a separating plate is pushed between the clearance of two adjacent resonator inner conductors 7*a* to 7*n* in order to at least partially reduce the direct coupling. It is also possible that they are only formed on the sidewalls $\mathbf{3}a_1$ to $\mathbf{3}a_4$ or $\mathbf{3}b_1$ to $\mathbf{3}b_4$ and/or on the front walls 4*a*, 4*b* in order to slightly reduce the volume. However, it still applies that two adjacent resonator inner conductors 7*a* to 7*n* are in the line of sight of one another over their entire length or over their predominant length.

The coaxial filter 1 can have any dimensions which differ depending on the frequency range used. For such a coaxial filter 1, the application frequency ranges typically lie between 500 MHz and 4500 MHz. A use above or below said ranges is also conceivable.

The housing 2 of the coaxial filter 1 can have side lengths that are greater than 20 mm, 50 mm, 75 mm, 100 mm, 150 mm, 200 mm, 250, or 300 mm, and that are preferably smaller than 400 mm, 375 mm, 325 mm, 275 mm, 225 mm, 175 mm, 125 mm, 90 mm, 70 mm, or 40 mm. These side lengths apply particularly in X- or Y-direction, i.e. along the corresponding sidewalls $\mathbf{3}a_1$, $\mathbf{3}a_2$, $\mathbf{3}a_3$, $\mathbf{3}a_4$ or $\mathbf{3}b_1$, $\mathbf{3}b_2$, $\mathbf{3}b_3$, $\mathbf{3}b_4$.

The housing 2 of the coaxial filter 1 can have a thickness that is preferably greater than 3 mm, 5 mm, 7 mm, 9 mm, 11 mm, 13 mm, or 15 mm, and which is further preferably smaller than 30 mm, 25 mm, 20 mm, 17 mm, 13 mm, 12 mm, 10 mm, 6 mm, or 4 mm. Most commonly, it lies between 7 mm and 10 mm. The wall thickness of metal sheets (e.g. the resonator inner conductors 7*a*, . . . , 7*n*) and/or of the housing elements 2*a*, 2*b* and/or of the lid arrangement 2*c* and/or of the front walls 4*a*, 4*b* is preferably greater than 0.5 mm, 1 mm, 1.5 mm, 2 mm, 2.5 mm, 3 mm, 3.5 mm, 4 mm, 4.5 mm, or 5 mm, and further preferably smaller than 7 mm, 6 mm, 4.8 mm, 3.8 mm, 2.8 mm, 1.8 mm, or 0.8 mm. Most commonly, it lies in a range between 1 mm to 2 mm.

In the following, some specific embodiments of the coaxial filter 1 shall be highlighted separately:

One embodiment is characterized by the following features:

the at least one pedestal arrangement 11 is integral with:

a) at least one front wall 4*a*, 4*b* and/or the at least one sidewall $\mathbf{3}a_1$, $\mathbf{3}a_2$, $\mathbf{3}a_3$, $\mathbf{3}a_4$, $\mathbf{3}b_1$, $\mathbf{3}b_2$, $\mathbf{3}b_3$, $\mathbf{3}b_4$ of at least one trough-shaped housing element 2*a*, 2*b*; and/or b) the lid arrangement 2*c*.

A further embodiment is characterized by the following features:

the two trough-shaped housing elements 2*a*, 2*b* are connected to one another by at least one screw connection 26, wherein the at least one screw connection 26 runs through the at least one resonator inner conductor arrangement 6, 6*a* and at least partially through one sidewall $\mathbf{3}a_1$, $\mathbf{3}a_2$, $\mathbf{3}a_3$, $\mathbf{3}a_4$, $\mathbf{3}b_1$, $\mathbf{3}b_2$, $\mathbf{3}b_3$, $\mathbf{3}b_4$ of each of the two trough-shaped housing elements 2*a*, 2*b*.

Another embodiment is characterized by the following features:

at least one or all of the resonator inner conductors 7*a*, . . . , 7*n* of the at least one resonator inner conductor arrangement 6, 6*a* extend obliquely or at a right angle away from the connecting bridge 10; and/or at least two or all resonator inner conductors 7*a*, . . . , 7*n* of the at least one resonator inner conductor arrangement 6, 6*a* have the same length or have different lengths.

An additional embodiment is characterized by the following features:

at least a first and a second and a third coupling and/or decoupling device 12*a*, 12*b*, 12*c* are provided which are arranged at different points of the housing 2, and protrude from outside the housing 2 into the receiving space 5, and create a capacitive or inductive or galvanic coupling to different resonator inner conductors 7*a*, . . . , 7*n* of the at least one resonator inner conductor arrangement 6, 6*a*.

The invention is not limited to the embodiments described. Within the scope of the invention, any combination of all the features described and/or drawn is possible.

The invention claimed is:

1. A coaxial filter comprising:

a housing that delimits a common receiving space;

the housing being made of an electrically conducting material and comprising a first trough-shaped housing element that has first sidewalls and a first front wall, wherein between the first sidewalls, a first space is closed off by the first front wall on one of the sides of the first sidewalls, the first space forming a receiving space, and wherein the first sidewalls are integral with the first front wall, the first sidewalls and the first front wall of the housing element comprising a cast and/or extruded and/or milled part;

the housing further comprising one of:

(a1) a further trough-shaped housing element that comprises further sidewalls and a further front wall, wherein a further space between the further sidewalls is closed off on one of their sides by the further front wall, wherein the further sidewalls are integral with the further front wall, and wherein the first and further trough-shaped housing elements are placed on top of one another so the first and further sidewalls of both first and further trough-shaped housing elements run between the first and further front walls and surround the receiving space which is formed by the first and further spaces; or (b1) a lid arrangement, wherein the first sidewalls run between the first front wall and the lid arrangement and surround the receiving space which is formed by the first space;

at least one resonator inner conductor arrangement with a one-piece design arranged in the receiving space, the at least one resonator inner conductor arrangement consisting of or comprising a punched and/or lasered metal sheet;

the at least one resonator inner conductor arrangement comprising a plurality of resonator inner conductors which lie in the same plane and each have a first end and a second end spaced apart from the first end;

the at least one resonator inner conductor arrangement further comprising a connecting bridge that connects the resonator inner conductors to one another in an electrically conducting manner;

at least two adjacent resonator inner conductors of the at least one resonator inner conductor arrangement, which extend in the same direction away from the connecting bridge, being in a line of sight of one another over their entire length or over their predominant length;

wherein the at least one resonator inner conductor arrangement connecting bridge is divided into connecting bridge sections, some of the connecting bridge sections being offset from other connecting bridge sections, some of the connecting bridge sections being spaced apart at different distances from the sidewalls and running parallel thereto, portions of the resonator inner conductors extending from the connecting bridge sections having different lengths;

at least one first pedestal arrangement;

wherein the at least one resonator inner conductor arrangement rests on the at least one first pedestal arrangement and is held spaced apart:

from the front walls of the trough-shaped housing elements; or the first front wall of the trough-shaped housing element and the lid arrangement; or the at least one first pedestal arrangement extends in the direction of the at least one resonator inner conductor arrangement and ends at a distance from it; wherein the at least one resonator inner conductor arrangement is:

soldered to; and/or screwed to the first pedestal arrangement, wherein the first pedestal arrangement is at least partially penetrated by a thread, and wherein a screw head of a screw connection is arranged in the receiving space or outside of the housing; and a further pedestal arrangement which is formed on the further front wall and/or on the further sidewall of the further trough-shaped housing element, wherein the at least one resonator inner conductor arrangement is clamped between the first and further pedestal arrangements, and wherein the screw connection at least to some extent penetrates both first and further pedestal arrangements; or at least one spacer arranged between the at least one resonator inner conductor arrangement and the lid arrangement, the at least one resonator inner conductor arrangement being clamped between the first pedestal arrangement and the at least one spacer, wherein the screw connection at least to some extent penetrates the at least one spacer.

2. The coaxial filter according to claim 1, wherein:

the resonator inner conductor arrangement is designed as one piece consisting of or comprising a curved and/or milled and/or printed metal sheet.

3. The coaxial filter according to claim 1, wherein:

the at least one resonator inner conductor arrangement is galvanically separated from the housing, or the at least one resonator inner conductor arrangement is galvanically connected to the housing; and/or the second end of the resonator inner conductors is arranged at a distance from the housing; and/or the at least one resonator inner conductor arrangement runs centrally or outside from the center through the receiving space; and/or the at least one resonator inner conductor arrangement is soldered and/or screwed and/or clamped to the housing.

4. The coaxial filter according to claim 1, wherein:

the first pedestal arrangement comprises a plurality of individual pedestals spaced apart from one another or a continuous pedestal that extends over at least 50% along the length of a said sidewall;

the first pedestal arrangement consisting of or comprising a dielectric material and/or an electrically conducting material.

5. The coaxial filter according to claim 1, wherein:

the at least one resonator inner conductor arrangement is clamped between at least one first sidewall of the first trough-shaped housing element and at least one further sidewall of the further trough-shaped housing element.

6. The coaxial filter according to claim 1, wherein:

the at least one resonator inner conductor arrangement is soldered to a first sidewall of the first trough-shaped housing element; or the at least one resonator inner conductor arrangement has a segment which is curved at least with regard to a predominant part of the resonator inner conductors in a direction of a front side of the first trough-shaped housing element and soldered to said front side, or which is curved at least with regard to a predominant part of the resonator inner conductors in a direction of the lid arrangement and soldered to said lid arrangement.

7. The coaxial filter according to claim 1, wherein:

the second end of at least one or all resonator inner conductors of the at least one resonator inner conductor arrangement:

runs angled, for example, in an L-shaped manner; or is twice angled, for example, in a T-shaped or U-shaper manner; or has an enlarged width.

8. The coaxial filter according to claim 1, wherein:

plural or all resonator inner conductors of the at least one resonator inner conductor arrangement have over a first partial length, a smaller width than over a second partial length, which ends at the second end, wherein the first partial length for at least two resonator inner conductors has a different length, resulting in a band-stop characteristic.

9. The coaxial filter according to claim 1, wherein:

at least one capacitive or inductive overcoupling is provided between plural resonator inner conductors of the at least one resonator inner conductor arrangement that are not adjacent, wherein the inductive overcoupling is formed by an overcoupling rod that is galvanically connected to the two resonator inner conductors and runs between them and a front wall or the lid arrangement; or the capacitive overcoupling is formed by an overcoupling element, having at least two galvanically connected capacitive coupling surfaces, wherein each of said capacitive coupling surfaces is arranged spaced apart between one of the two resonator inner conductors and a front wall or the lid arrangement, wherein the overcoupling element is galvanically separated from the resonator inner conductors and the housing.

10. The coaxial filter according to claim 1, wherein:

at least one separating plate is arranged between two adjacent resonator inner conductors of the at least one resonator inner conductor arrangement in order to reduce the coupling of the two resonator inner conductors, wherein the at least one separating plate is galvanically connected to:

one sidewall of each of the first and further trough-shaped housing elements placed on top of one another and/or to at least one front wall of both first and further trough-shaped housing elements placed on top of one another; or one first sidewall and/or one first front wall of the first trough-shaped housing element or the lid arrangement.

11. The coaxial filter according to claim 1, further comprising:

at least a first pedestal arrangement extending in a direction of the at least one resonator inner conductor arrangement and ending at a distance from said at least one resonator inner conductor arrangement, the at least one pedestal arrangement being integral with: (a2) at least one of said front walls of at least one of said trough-shaped housing elements or (b2) the lid arrangement.

12. The coaxial filter according to claim 1, wherein:

the resonator inner conductors of the at least one resonator inner conductor arrangement extend on both sides away from the connecting bridge.

13. The coaxial filter according to claim 12, wherein:

the connecting bridge is divided into different connecting bridge sections, wherein the connecting bridge sections run offset to one another.

14. The coaxial filter according to claim 12, wherein:

the at least one resonator inner conductor arrangement is structured so as to be mirror-symmetric, wherein the mirror axis runs through the connecting bridge, and wherein the connecting bridge is many times narrower than at least one or all resonator inner conductors, resulting in a low-pass characteristic.

15. The coaxial filter according to claim 1, wherein:

one electrically conducting separator begins on each sidewall of the trough-shaped housing elements placed on top of one another, or on a first sidewall of the first trough-shaped housing element and is galvanically conductingly connected to these or this sidewall and protrudes into the receiving space and runs in a direction of a second sidewall and ends there by forming an opening with the second sidewall, thereby dividing the receiving space at least into a first receiving chamber and a second receiving chamber and an opening which connects the first and second receiving chambers;

a plurality of resonator inner conductors of the at least one resonator inner conductor arrangement are arranged in the first and the second receiving chamber of the receiving space.

16. The coaxial filter according to claim 15, wherein:

the connecting bridge is:

arranged between the two separators; or arranged between the separator and the lid arrangement, wherein the first end of the corresponding resonator inner conductors has a segment that is curved in the direction of the front wall, and so the resonator inner conductors run over the predominant part of their length spaced apart at a predefined distance from the lid arrangement.

17. The coaxial filter according to claim 1, wherein:

a further resonator inner conductor arrangement is provided, wherein:

the first resonator inner conductor arrangement is fastened to the first front wall of the first trough-shaped housing element, and the further resonator inner conductor arrangement is fastened to the further front wall of the further trough-shaped housing element; or a third trough-shaped housing element is provided, wherein the further front wall of the further trough-shaped housing element, which is closed with the lid arrangement, is placed onto third sidewalls of the third trough-shaped housing element, thus forming a further receiving space, wherein the further resonator inner conductor arrangement is arranged in the further receiving space, and wherein at least one coupling opening is introduced in the first front wall of the first trough-shaped housing element, and so a coupling exists between the individual resonator inner conductor arrangements in the different receiving spaces.

18. The coaxial filter according to claim 17, wherein:

between the resonator inner conductor arrangement and the further resonator inner conductor arrangement, which are arranged in the same receiving space, a separating wall is arranged, having at least one coupling opening, through which the individual resonator inner conductor arrangements are coupled; or the resonator inner conductor arrangement and the further resonator inner conductor arrangement, which are arranged in the same receiving space, are connected to one another by means of a curved connecting section and designed as one piece.

* * * * *